US010221557B2

(12) United States Patent
Espinosa

(10) Patent No.: US 10,221,557 B2
(45) Date of Patent: Mar. 5, 2019

(54) HOLD DOWN SYSTEM USING HOLLOW BEARING MEMBERS

(71) Applicant: Thomas M Espinosa, Snohomish, WA (US)

(72) Inventor: Thomas M Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 0 days.

(21) Appl. No.: 14/742,780

(22) Filed: Jun. 18, 2015

(65) Prior Publication Data

US 2015/0308100 A1 Oct. 29, 2015

Related U.S. Application Data

(63) Continuation of application No. 12/588,101, filed on Oct. 2, 2009, now Pat. No. 9,097,000.
(Continued)

(51) Int. Cl.
*E04B 1/06* (2006.01)
*E04B 2/60* (2006.01)
(Continued)

(52) U.S. Cl.
CPC ..... *E04B 1/40* (2013.01); *E04B 1/08* (2013.01); *E04B 1/2604* (2013.01); *E04B 2/16* (2013.01);
(Continued)

(58) Field of Classification Search
CPC . E04B 1/08; E04B 1/4157; E04B 2/60; E04B 2/58; E04B 2/16; E04B 5/023;
(Continued)

(56) References Cited

U.S. PATENT DOCUMENTS 1,360,774 A 11/1920 Dermot et al.
1,552,474 A * 9/1925 Dornier ..... B64C 1/065 52/634
(Continued)

FOREIGN PATENT DOCUMENTS

JP 05009941 A 1/1993
JP 06185072 A 7/1994

*Primary Examiner* — Phi D A
(74) *Attorney, Agent, or Firm* — Shlesinger, Arkwright & Garvey LLP

(57) ABSTRACT

Structural member for a reinforced stud wall including a tie rod. A horizontal longitudinal hollow bearing member having a horizontal longitudinal axis and horizontal and parallel top and bottom walls extending along the horizontal longitudinal axis. The top and bottom walls are configured to support a downward compression force transverse to the top wall from the tie rod when the tie rod is attached to the top wall. First and second web flanges connect the top and bottom walls to form first and second "I"-shaped cross-sections joined together side-by-side, the web flanges extending along the longitudinal axis of the hollow bearing member. The web flanges are configured to transfer downward compression force on the top wall to the bottom wall. Opening through the top and bottom walls allows the tie rod to extend vertically therethrough, the opening being confined within a space between vertical portions of the web flanges.

8 Claims, 20 Drawing Sheets

Related U.S. Application Data

(60) Provisional application No. 61/136,797, filed on Oct. 3, 2008.

(51) Int. Cl.

| | |
|---|---|
| ***E04B 1/26*** | (2006.01) |
| ***E04B 1/08*** | (2006.01) |
| ***E04B 1/41*** | (2006.01) |
| *E04B 2/16* | (2006.01) |
| *E04B 1/38* | (2006.01) |

(52) U.S. Cl.
CPC ..... *E04B 2/60* (2013.01); *E04B 2001/2688* (2013.01); *E04B 2001/405* (2013.01)

(58) Field of Classification Search
CPC . E04B 1/4114; E04B 1/21; E04B 1/22; E04B 1/24; E04C 3/00; E04C 3/30; E04C 5/08; E04C 5/12; E04C 2003/02
USPC ..... 52/293.3, 293.1, 295, 223.13, 223.14, 52/292; 411/536, 353
See application file for complete search history.

(56) References Cited

U.S. PATENT DOCUMENTS 1,656,810 A 1/1928 Arnstein
2,263,272 A * 11/1941 Moss ..... E04C 3/06 228/151
2,727,712 A 12/1955 Holmboe
2,891,759 A 6/1959 Holmboe, Sr.
4,557,091 A * 12/1985 Auer ..... E04B 2/72 52/282.2
4,616,960 A * 10/1986 Gladish ..... B65G 51/03 104/134
4,713,924 A 12/1987 Toti
4,812,096 A 3/1989 Peterson
4,863,307 A * 9/1989 Jones ..... E01C 11/221 404/7
4,875,314 A 10/1989 Boilen
4,945,695 A * 8/1990 Majurinen ..... E04B 1/16 52/220.3
5,002,318 A 3/1991 Witter
5,073,061 A * 12/1991 Jones ..... E01C 11/221 404/7
5,377,447 A 1/1995 Fritch
5,531,054 A 7/1996 Ramirez
5,535,561 A 7/1996 Schuyler
5,540,530 A 7/1996 Fazekas
5,570,549 A 11/1996 Lung et al.
5,625,996 A * 5/1997 Bechtel ..... E04B 1/943 52/834
5,729,944 A 3/1998 De Zen
5,769,562 A * 6/1998 Jones ..... A01G 1/08 404/7
6,099,201 A * 8/2000 Abbrancati ..... E01C 11/221 404/4
6,195,949 B1 3/2001 Schuyler
6,230,451 B1 5/2001 Stoller
6,322,045 B1 11/2001 Andros
6,327,831 B1 12/2001 Leek
6,442,908 B1 9/2002 Naccarato et al.
6,494,654 B2 12/2002 Espinosa
6,688,058 B2 2/2004 Espinosa
6,715,258 B1 4/2004 Mueller
6,834,471 B2 12/2004 Takagi et al.
6,843,027 B2 1/2005 Gaddie et al.
6,951,078 B2 10/2005 Espinosa
7,051,988 B2 * 5/2006 Shaw ..... E04G 13/00 248/309.1
7,059,573 B2 6/2006 Calieja
7,150,132 B2 12/2006 Commins
7,159,366 B2 1/2007 Espinosa
7,287,355 B2 10/2007 Commins
7,444,789 B1 11/2008 Moore
7,513,083 B2 4/2009 Pryor et al.
7,621,085 B2 11/2009 Commins
7,665,257 B2 2/2010 Posey
7,665,258 B2 2/2010 Espinosa
7,762,030 B2 7/2010 Espinosa
7,828,263 B2 11/2010 Bennett et al.
7,967,524 B2 6/2011 Jones
8,127,506 B2 * 3/2012 Schneider ..... B62D 29/002 296/187.02
8,925,256 B2 * 1/2015 Donoho ..... A01M 29/32 52/101
2002/0073634 A1 6/2002 Bolinger et al.
2003/0159397 A1 8/2003 Birnbaum
2006/0070340 A1 * 4/2006 Fanucci ..... E04C 3/29 52/837
2006/0156657 A1 7/2006 Commins
2014/0109503 A1 * 4/2014 Fielder ..... E04B 2/8635 52/426

* cited by examiner

FIG. 12
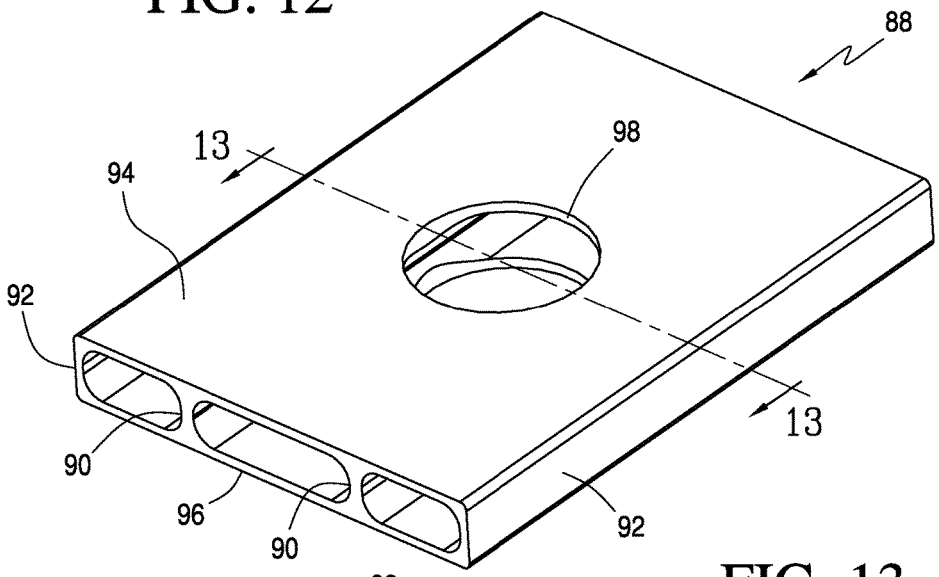
FIG. 13
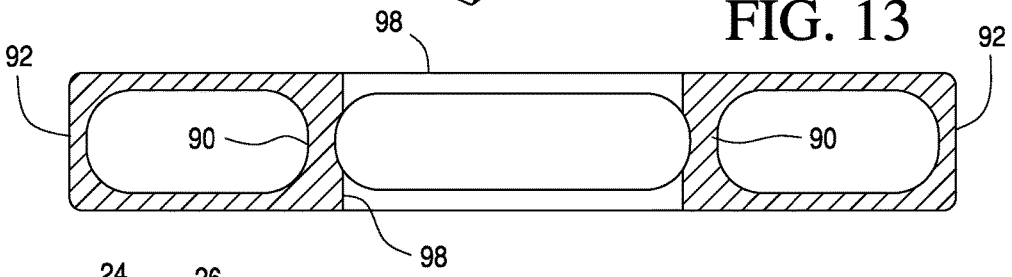
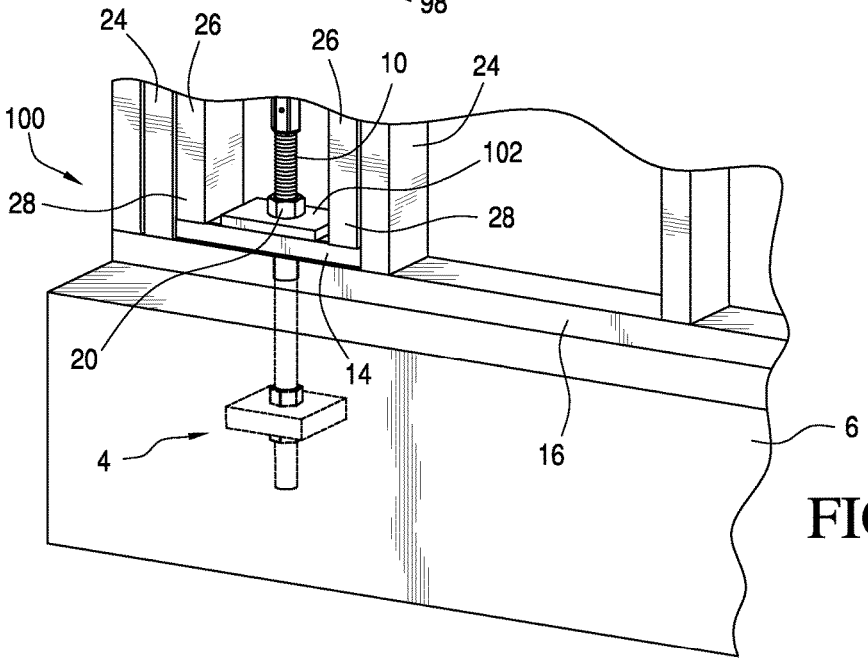
FIG. 14

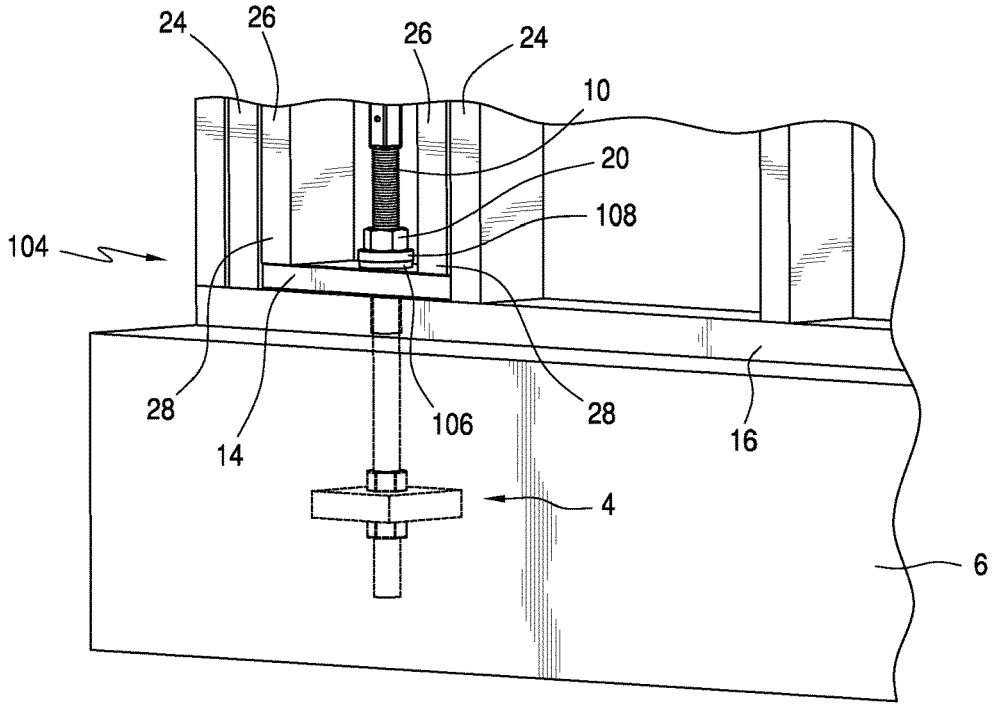
FIG. 15
FIG. 16
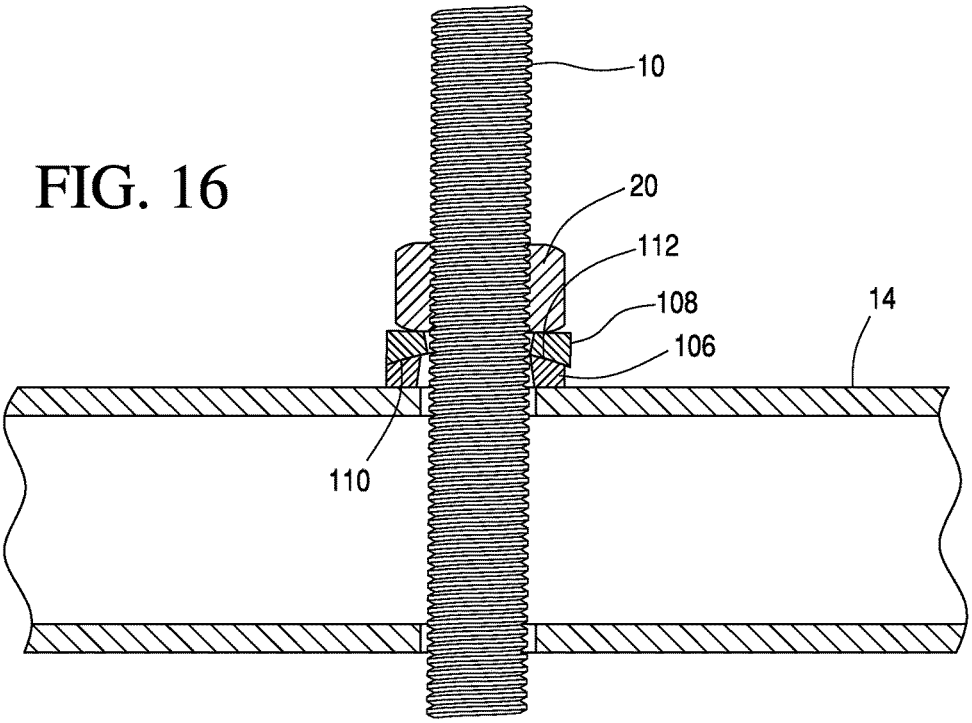

HOLD DOWN SYSTEM USING HOLLOW BEARING MEMBERS

RELATED APPLICATION

This is a continuation application of application Ser. No. 12/588,101, filed Oct. 2, 2009, claiming the priority benefit of provisional application Ser. No. 61/136,797, filed Oct. 3, 2008, both of which applications are herein incorporated by reference.

FIELD OF THE INVENTION

The present invention is generally directed to a tension hold down system used in walls in light frame construction to resist uplift and to compensate for wood shrinkage in wood frame construction and compression loading.

BACKGROUND OF THE INVENTION

Prior art hold down systems, such as one disclosed in U.S. Pat. No. 6,951,078, typically use a tie-rod that extends inside a stud wall from the foundation to the top floor.

SUMMARY OF THE INVENTION

The present invention provides components and combinations thereof for a wall hold down system that uses a tie rod that extends from the foundation through the top floor. The components secure the wall to the tie rod at the foundation, floor, midfloor and top floor levels using hollow bearing members that resist bending. The bearing members are hollow having web flanges that provide rigidity against bending. Holes are provided in the bearing members for the tie rod to pass through and are positioned between and adjacent the web flanges for effective transmission of load to the wall structure.

The present invention provides a structural member for a reinforced stud wall including a tie rod connected to a foundation of the wall. The structural member comprises a longitudinal hollow member having top and bottom walls; and first and second web flanges connecting the top and bottom walls, the web flanges extending along a longitudinal axis of the hollow member. An opening through the top and bottom walls allow the tie rod to extend therethrough, the opening being disposed between the web flanges.

The present invention also provides a reinforced stud wall for a building having at least one floor, a foundation and at least one ceiling, comprising a cross member operably secured to a pair of adjacent studs; a tie rod having one end operably connected to a foundation of a building and a threaded another end extending through the cross member; and a nut operably secured to the another end and the cross member. The cross member comprises a longitudinal hollow member having top and bottom walls, first and second web flanges connecting the top and bottom walls, the web flanges extending along a longitudinal axis of the hollow member, and an opening through the top and bottom walls to allow a tie rod to extend therethrough, the opening being disposed between the web flanges.

The present invention further provides another structural member, comprising a bracket including a horizontal member, a vertical member extending downwardly from an intermediate portion of the horizontal member, and an angled member connecting one end of the horizontal member and a free end of the vertical member. The bracket forms an inverted L-shaped configuration with the vertical member and a portion of the horizontal member, the portion for being disposed between a top end of a stud and below a cross member and the vertical member for being engaged with a vertical surface of the stud.

The present invention will become apparent from the following detailed description.

BRIEF DESCRIPTIONS OF THE DRAWINGS

Figure 1:
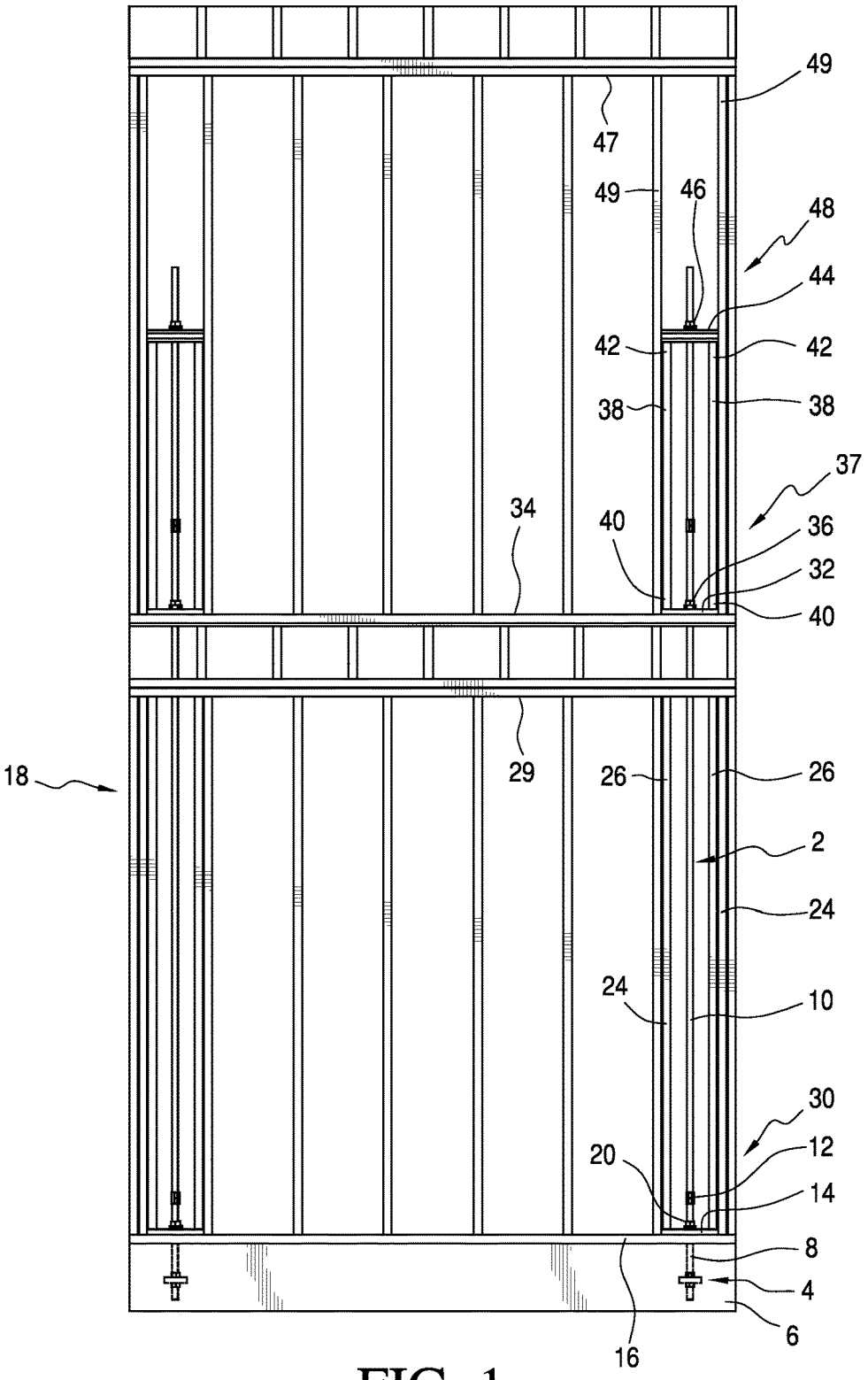
FIG. 1 is a two-story wall system using a hold down system using components made and installed in accordance with the present invention.
Figure 3:
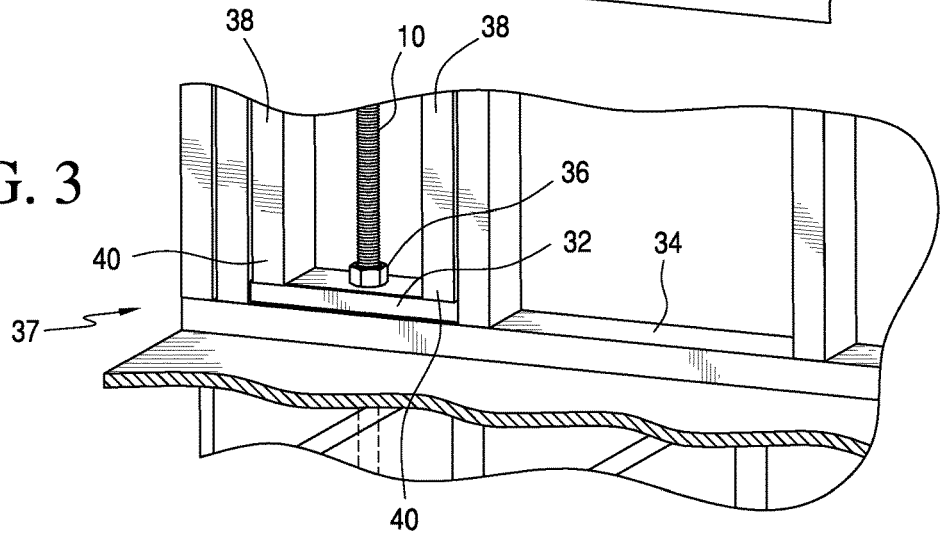

FIG. 3 a perspective, fragmentary and enlarged view of the wall system of FIG. 1, showing details of attachment of the wall system at the floor.

Figure 3A:
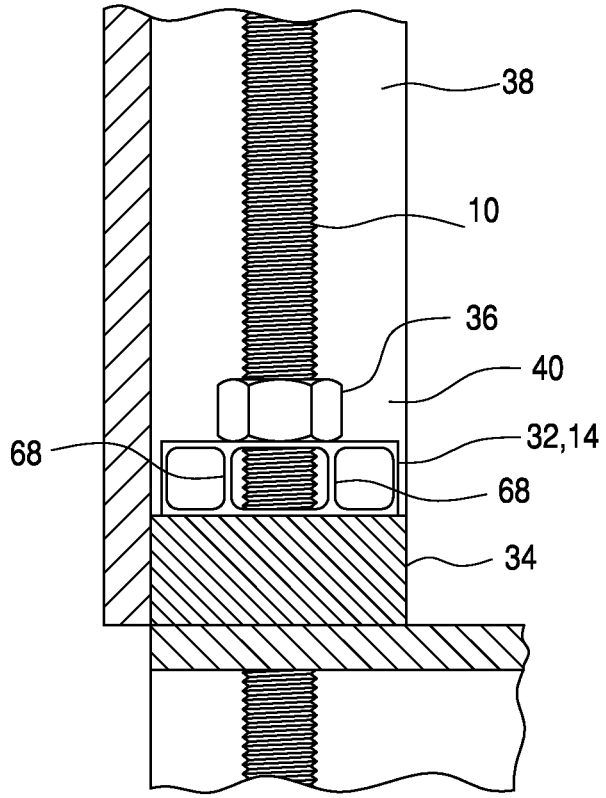

FIG. 3A is side elevational view of FIG. 3 with some parts of the wall system removed for clarity.

Figure 4:
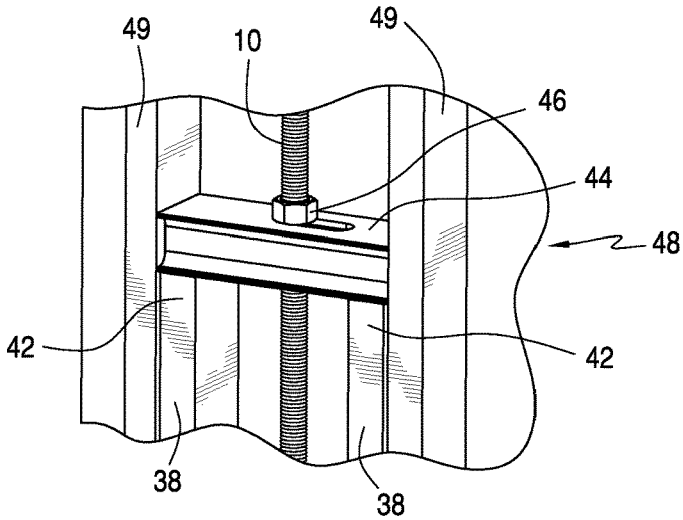

FIG. 4 a perspective, fragmentary and enlarged view of the wall system of FIG. 1, showing details of attachment of the wall system at the termination of the hold down system at the top floor.

Figure 4A:
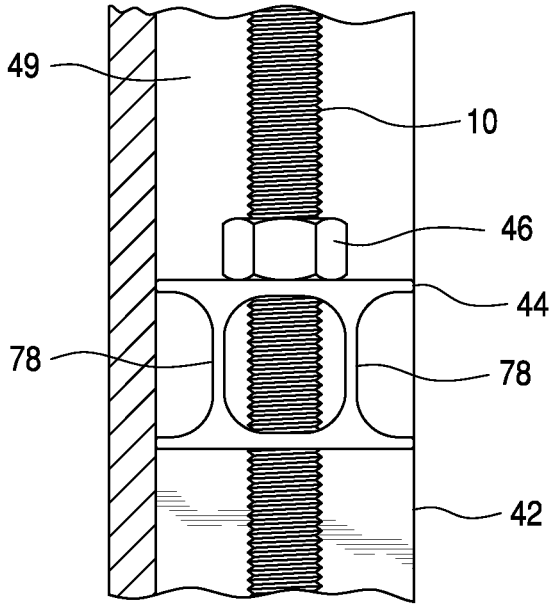

FIG. 4A is a side elevational view of FIG. 4 with some parts of the wall system removed for clarity.

Figure 5:
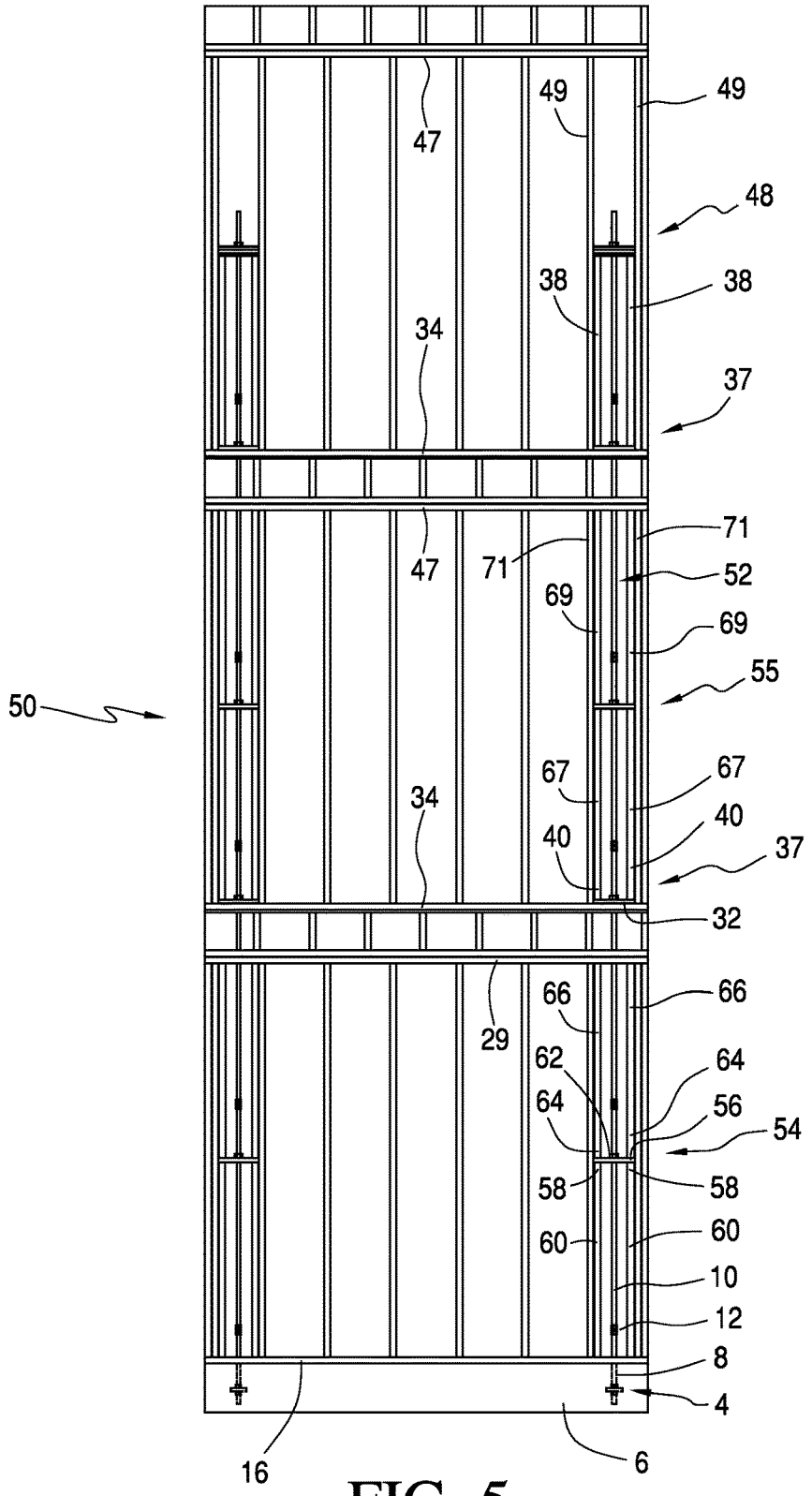

FIG. 5 a is a three-story wall system using a hold down system using components made and installed in accordance with the present invention.

Figure 6:
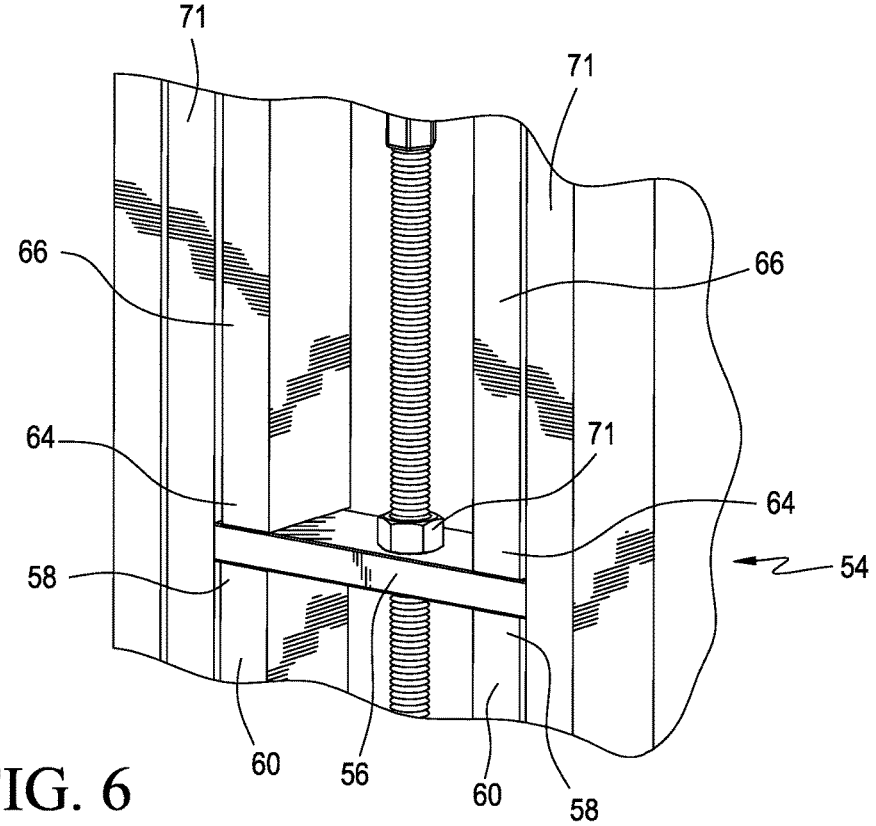

FIG. 6 a perspective, fragmentary and enlarged view of the wall system of FIG. 5, showing details of attachment of the wall system at midfloor.

Figure 7:
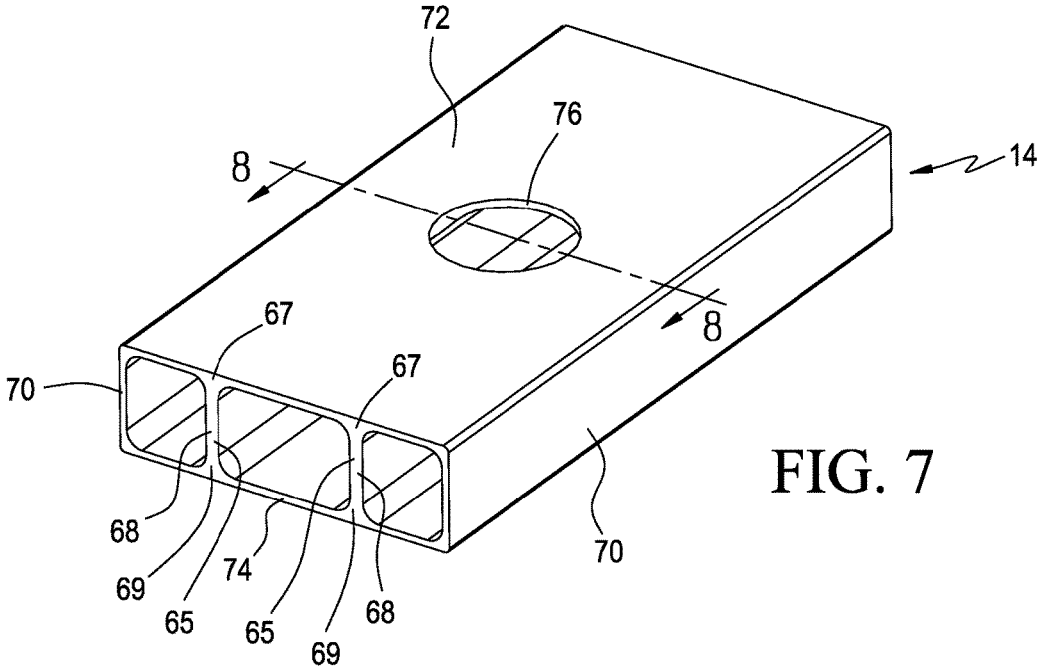

FIG. 7 a perspective view of a bearing member made and installed in accordance with the present invention.

Figure 8:
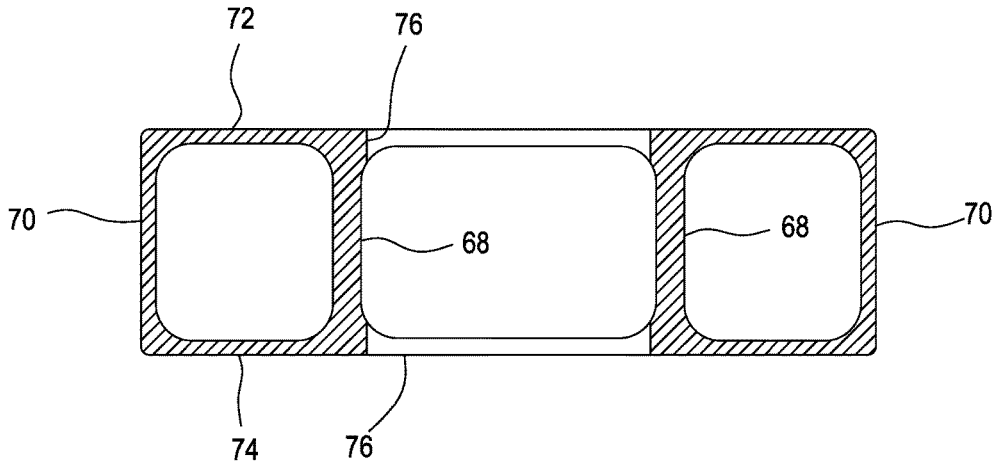

FIG. 8 is a cross-sectional view taken along line 8-8 in FIG. 7.

Figure 9:
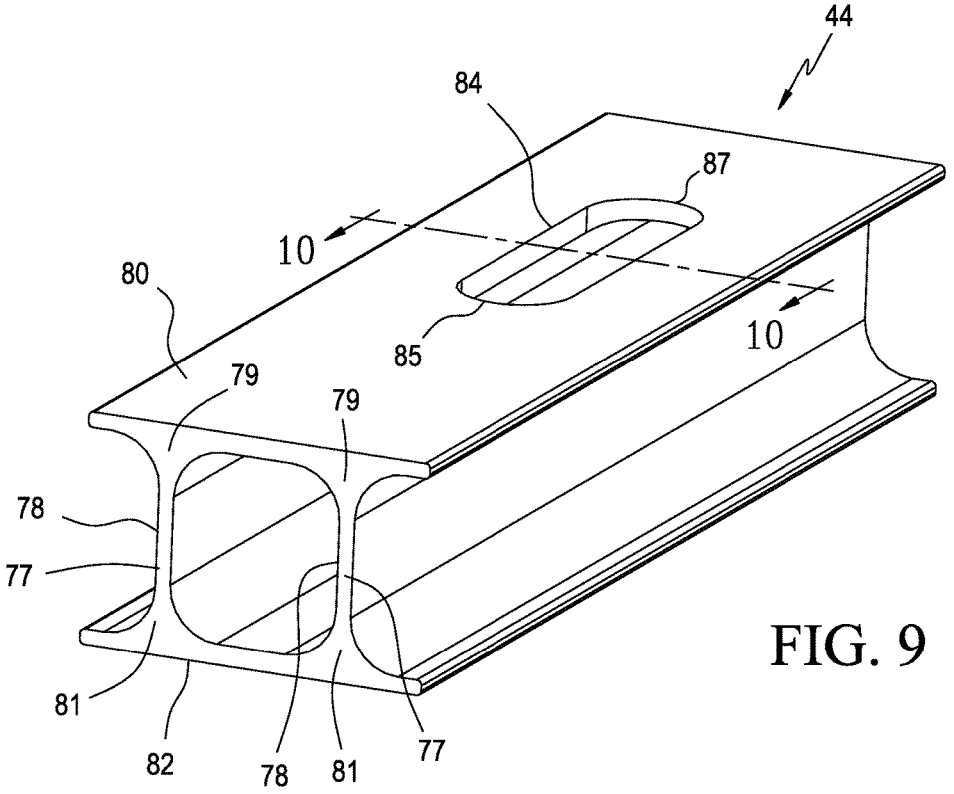

FIG. 9 is a perspective view of a bridge member made and installed in accordance with the present invention.

Figure 10:
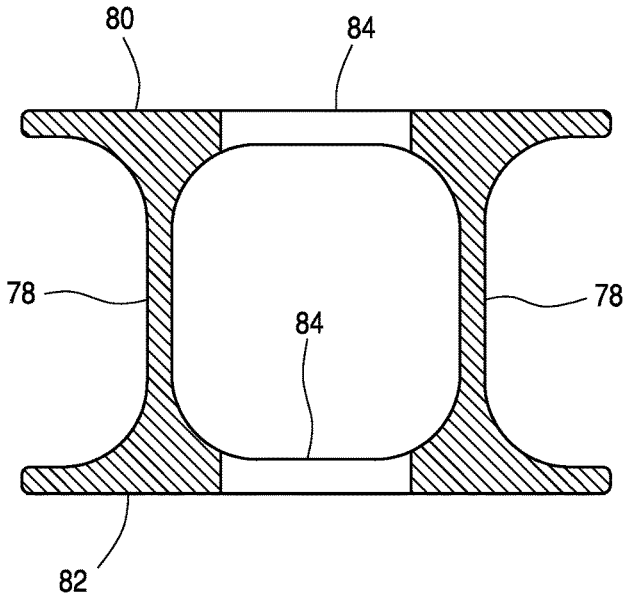

FIG. 10 is a cross-sectional view taken along line 10-10 in FIG. 9.

Figure 2:
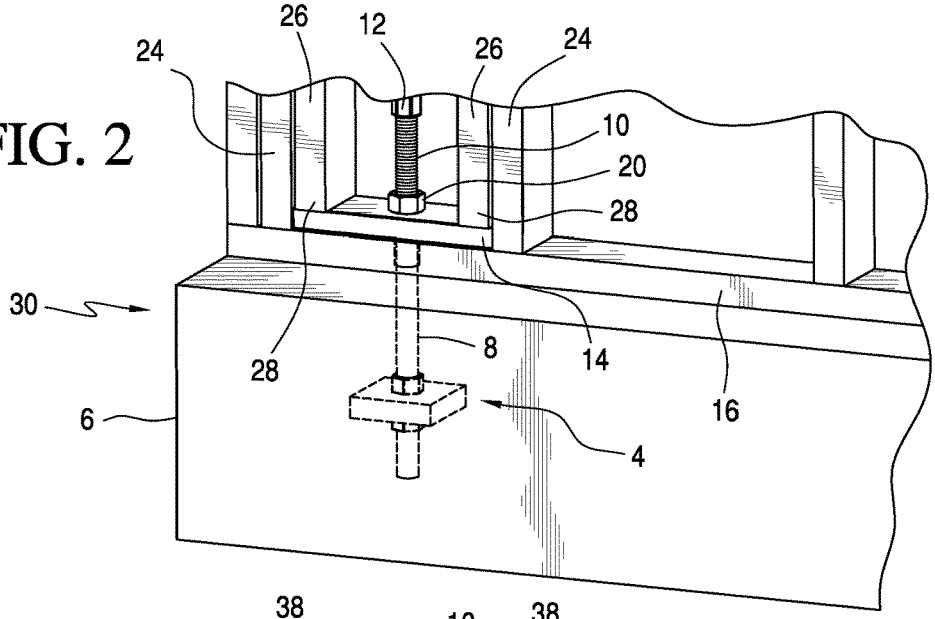
FIG. 2 is a perspective, fragmentary and enlarged view of the wall system of FIG. 1, showing details of attachment of the wall system to the building foundation.
Figure 11:
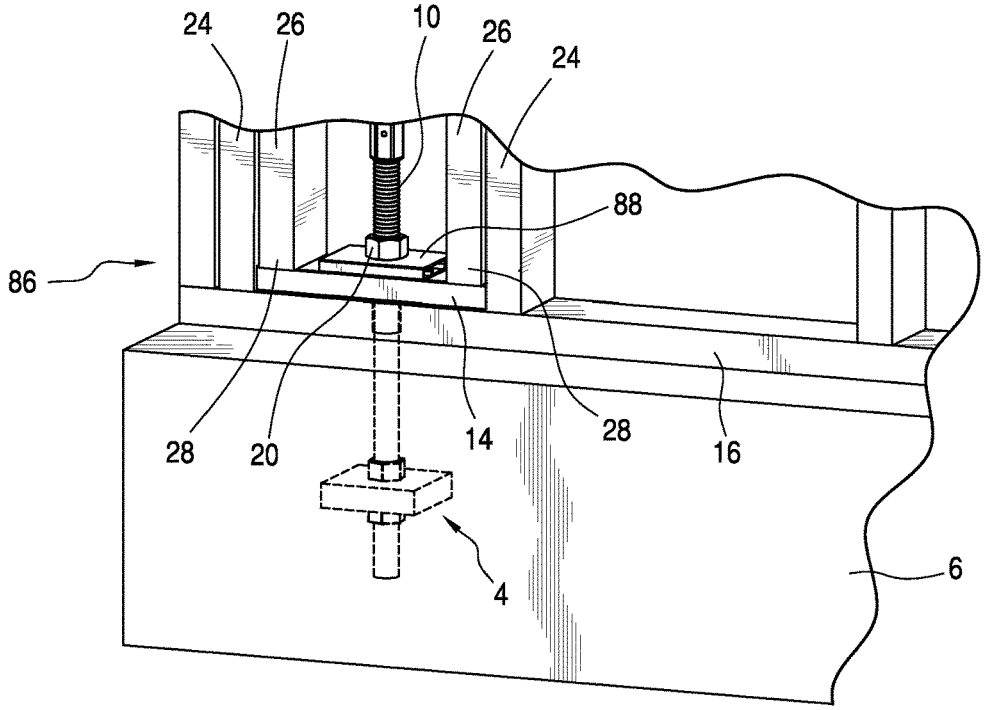

FIG. 11 is a perspective, fragmentary view of another embodiment of FIG. 2 of the details of attachment of the wall system to the building foundation.

FIG. 12 is a perspective view of another bearing member made and installed in accordance with the present invention.

FIG. 13 is a cross-sectional view taken along line 13-13 in FIG. 12.

FIG. 14 is a perspective, fragmentary view of another embodiment of FIG. 2.

FIG. 15 is a perspective, fragmentary view of another embodiment of FIG. 2 of the details of attachment of the wall system to the building foundation.

FIG. 16 is an enlarged, cross-sectional view of portions of FIG. 15.

FIGS. 17-20 are perspective, fragmentary views of other embodiments of FIG. 3 of the details of attachment of the wall system at the floor.

Figure 17:
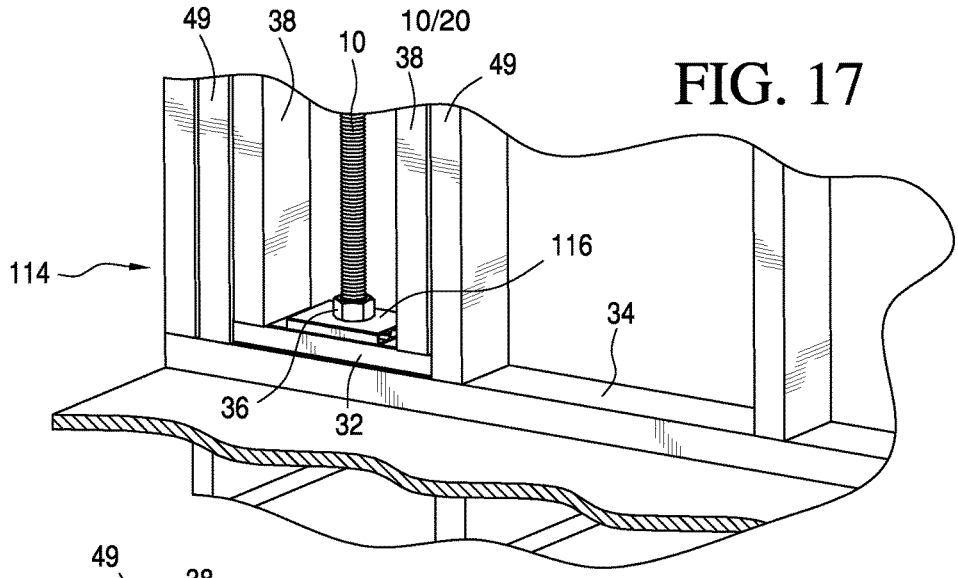
Figure 17A:
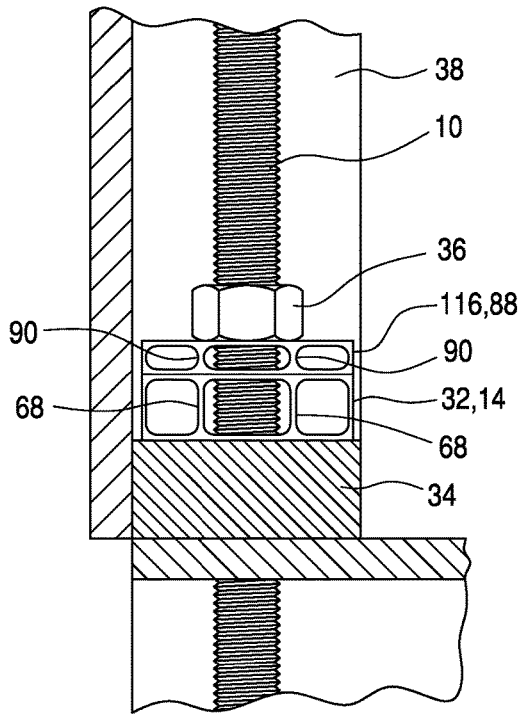

FIG. 17A is a side elevational view of FIG. 17 with some components of the wall system removed for clarity.

Figure 19:
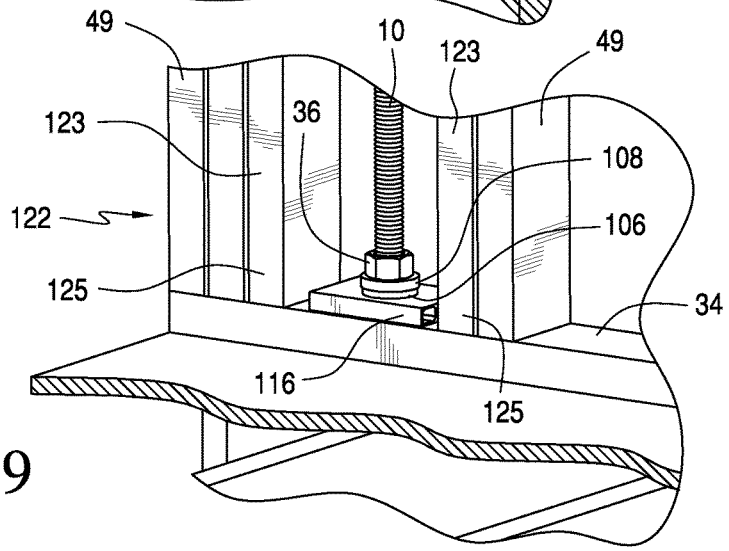
Figure 19A:
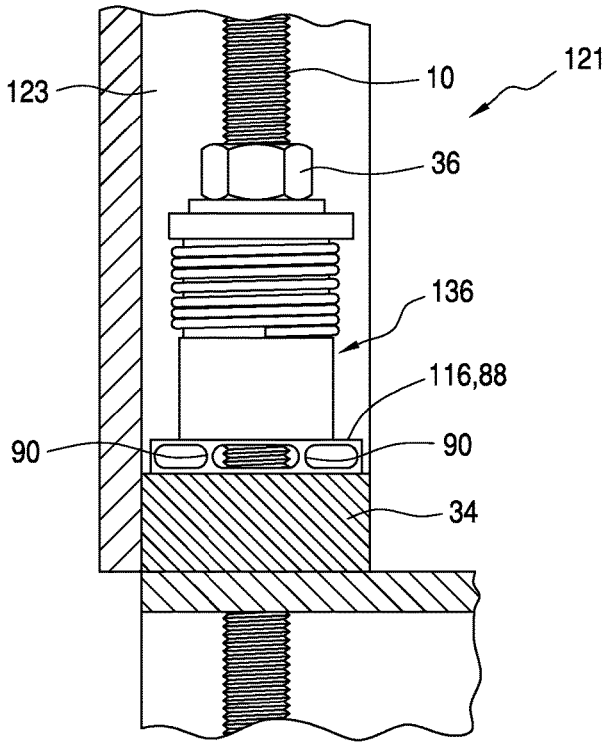

FIG. 19A is a side elevational view of FIG. 19 with some components of the wall system removed for clarity and washers replaced with a tensioning device.

Figure 20:
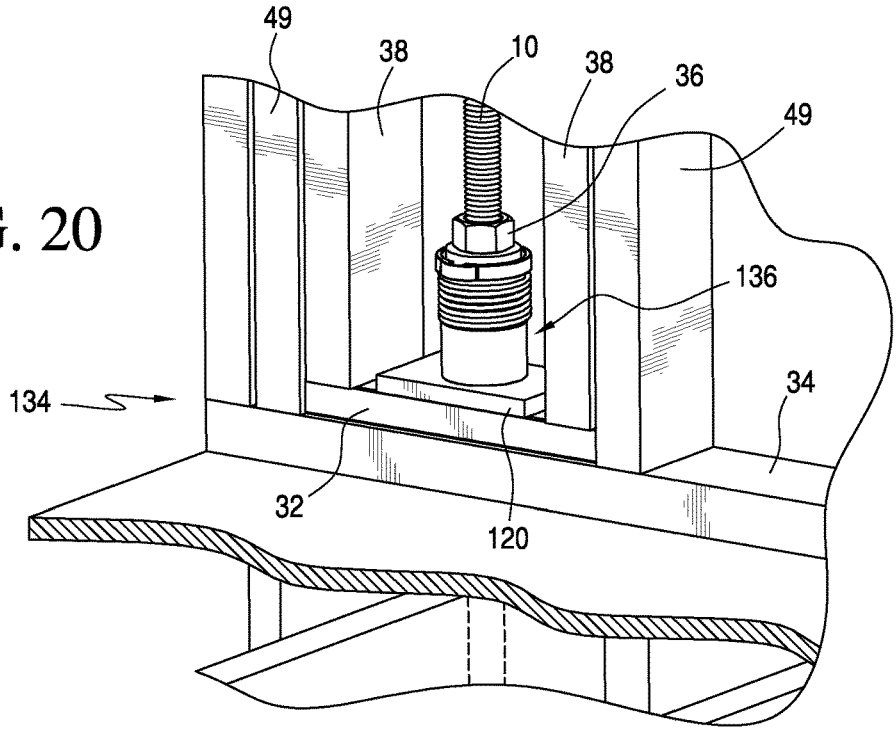
Figure 21:
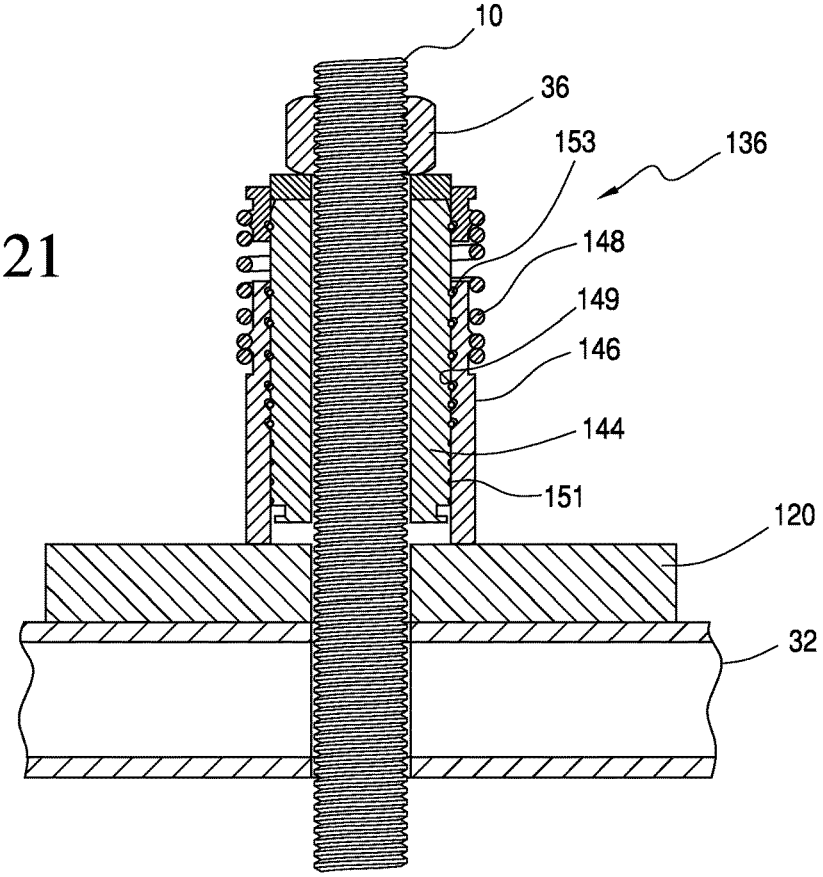

FIG. 21 is a cross-sectional view of portions of FIG. 20.

Figure 22:
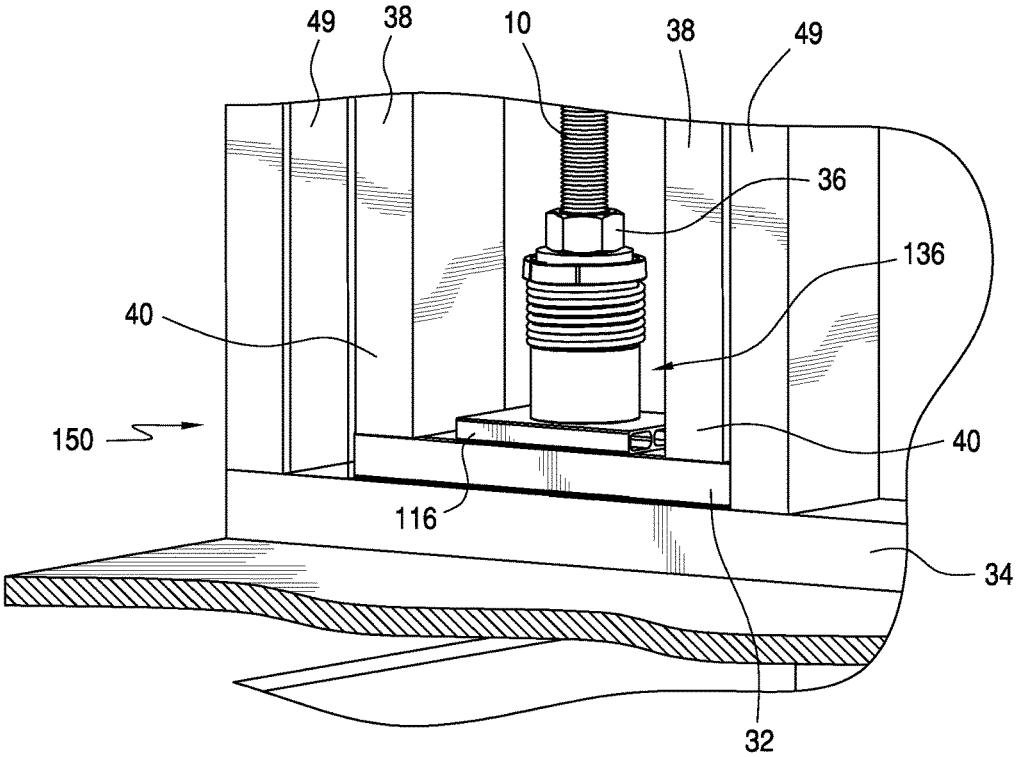

FIG. 22 is perspective, fragmentary view of another embodiment of FIG. 3 of the details of attachment of the wall system at the floor.

Figure 22A:
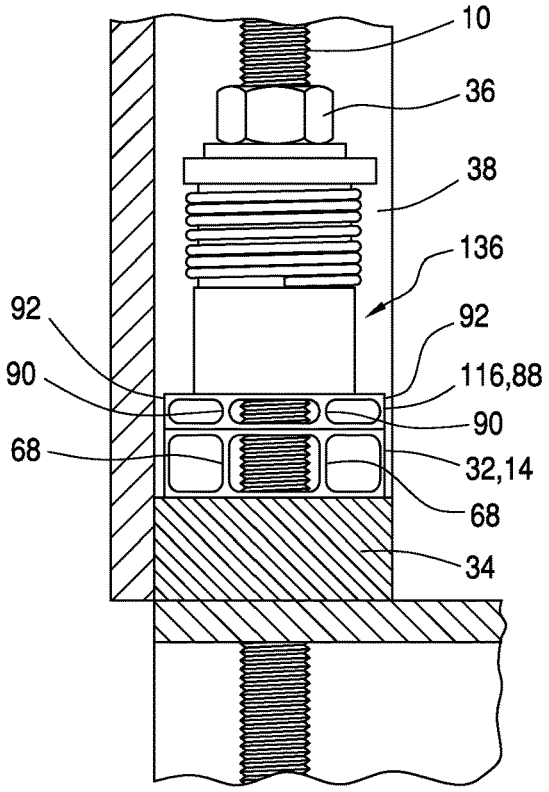

FIG. 22A is a side elevational view of FIG. 22 with some components of the wall system removed for clarity.

Figure 22B:
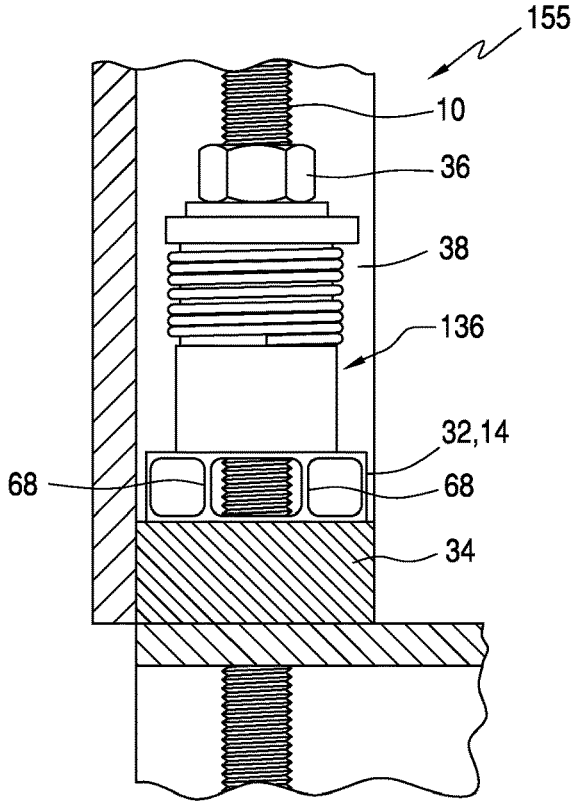

FIG. 22B is a side elevational view of FIG. 22 with some components of the wall system removed for clarity, showing another embodiment of a floor attachment where the second top bearing member has been removed.

FIGS. 23-29 are perspective, fragmentary views of other embodiments of FIG. 4 of the details of attachment of the wall system at the termination of the hold down system at the top floor.

Figure 23:
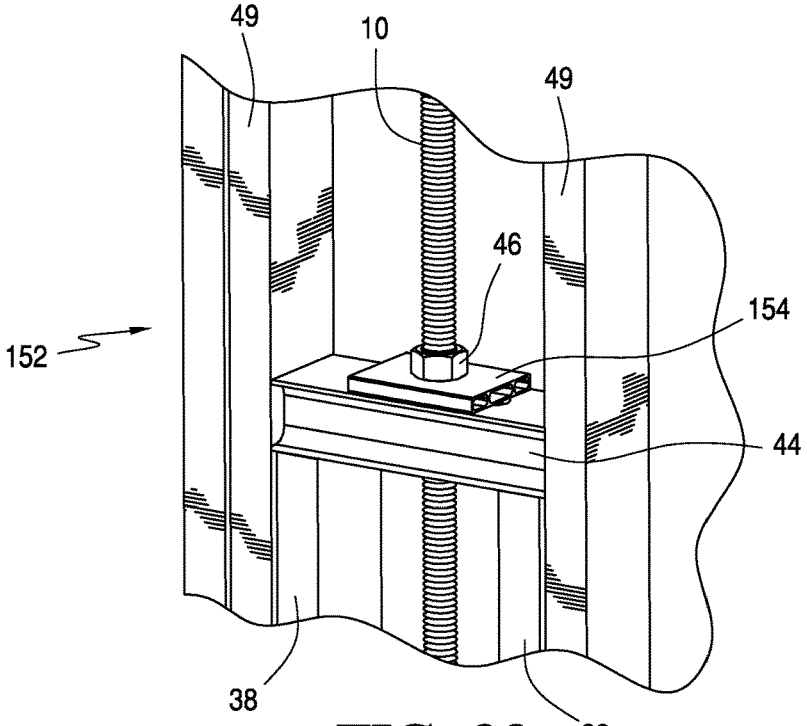
Figure 23A:
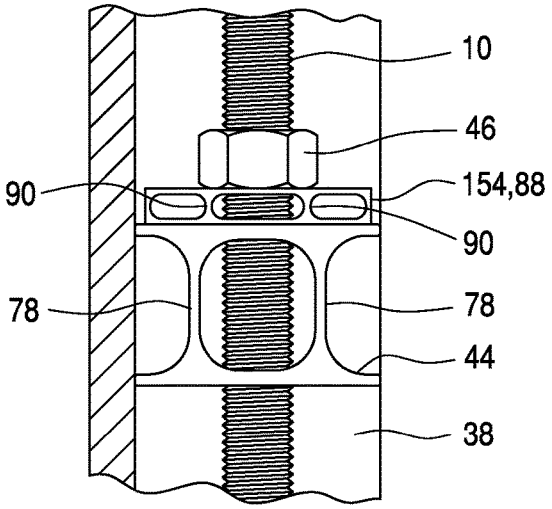

FIG. 23A is a side elevational view of FIG. 23 with some components of the wall system removed for clarity.

Figure 26A:
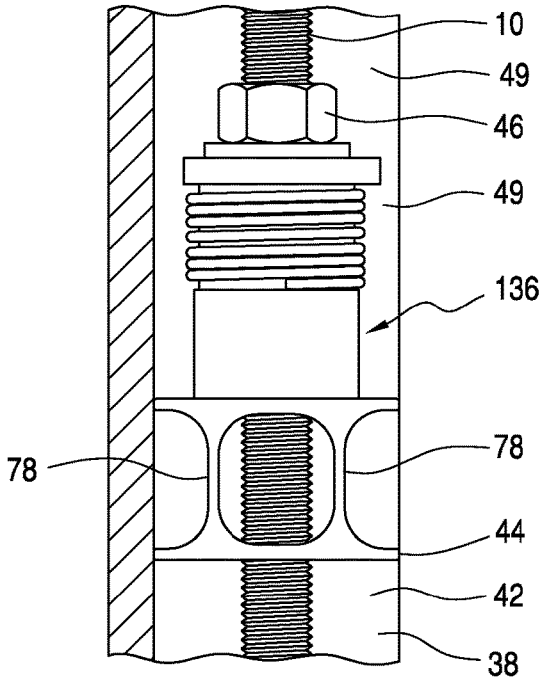
Figures 24, 25, 26:
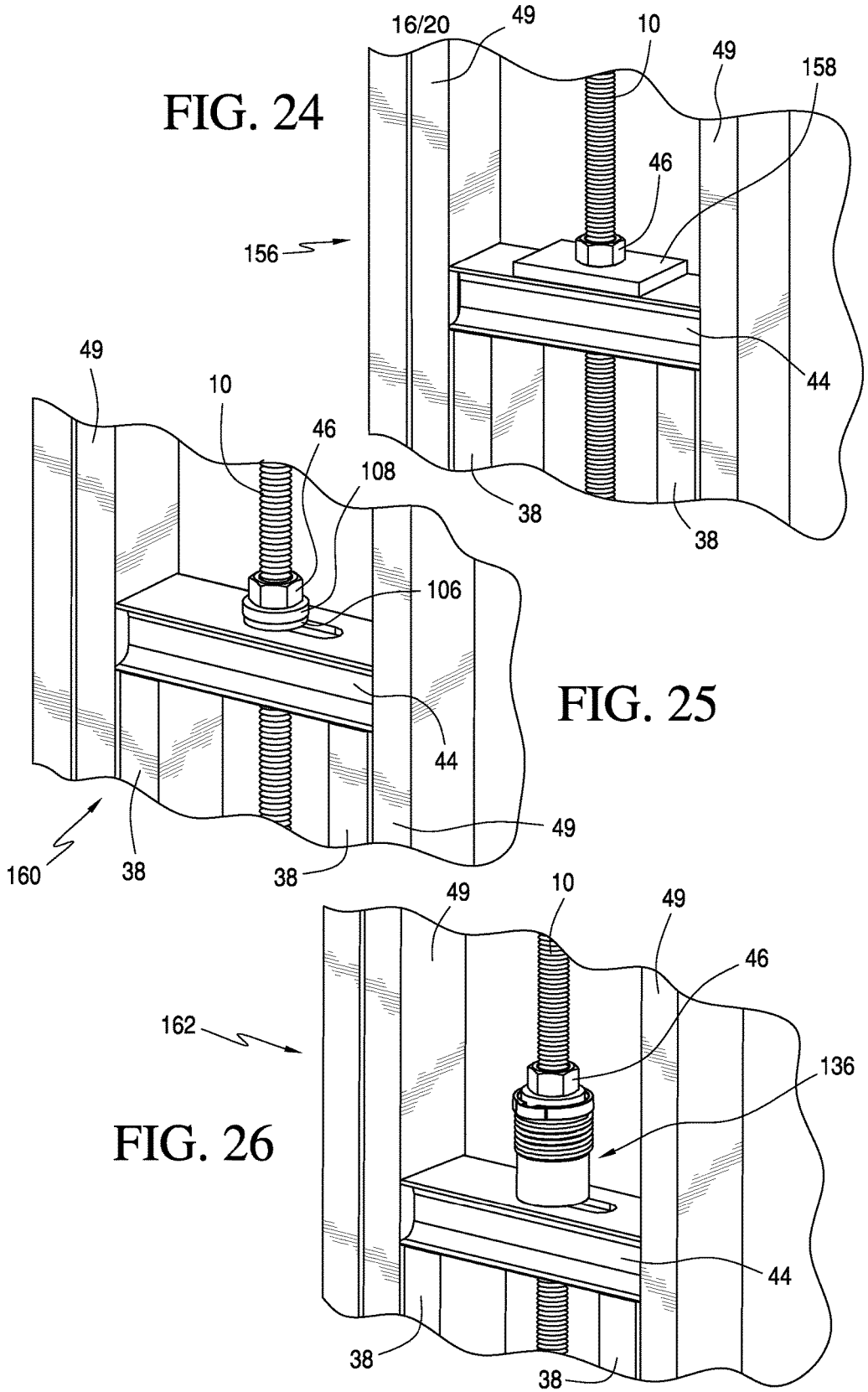

FIG. 26A is a side elevational view of FIG. 26 with some components of the wall system removed for clarity.

Figure 27:
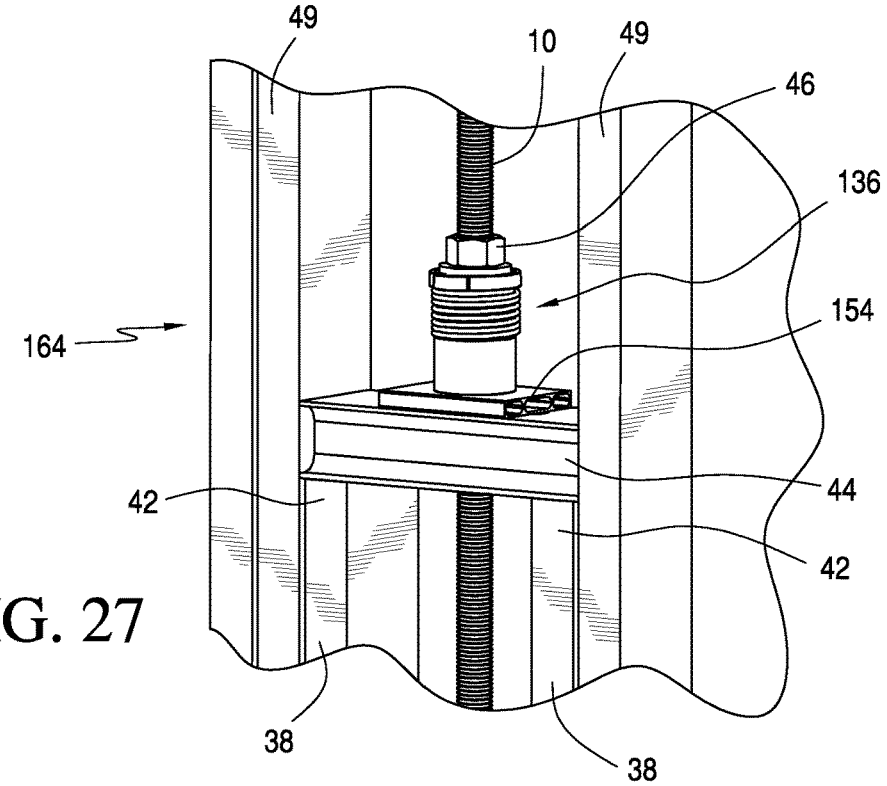
Figure 27A:
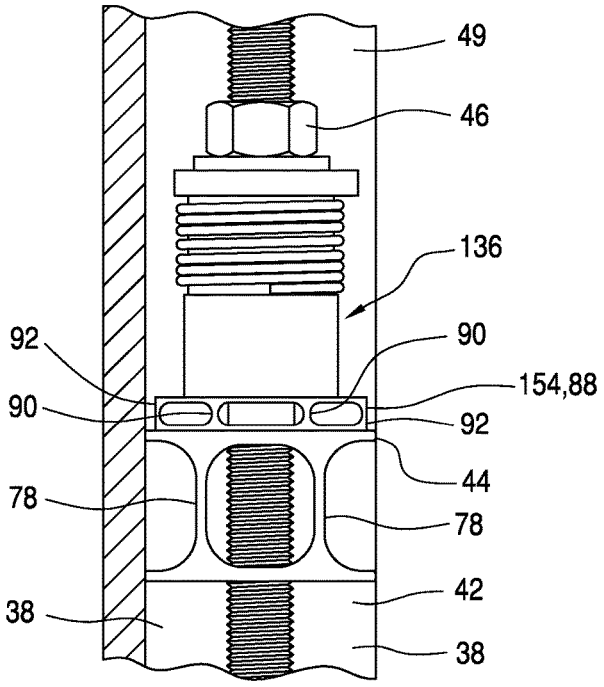

FIG. 27A is a side elevational view of FIG. 27 with some components of the wall system removed for clarity.

Figure 30:
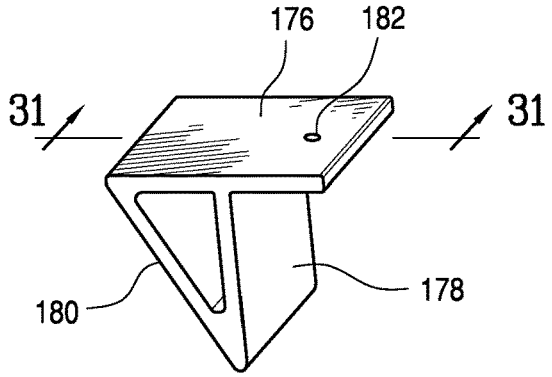

FIG. 30 is a perspective view of a bracket made and installed in accordance with the present invention.

Figure 31:
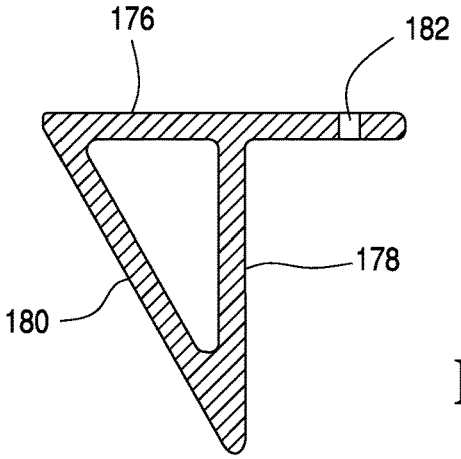

FIG. 31 is a cross-sectional view taken along line 31-31 of FIG. 30.

Figure 32A:
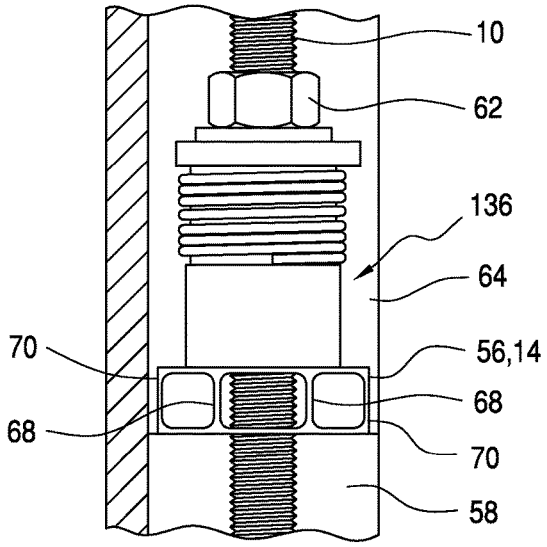
Figure 32:
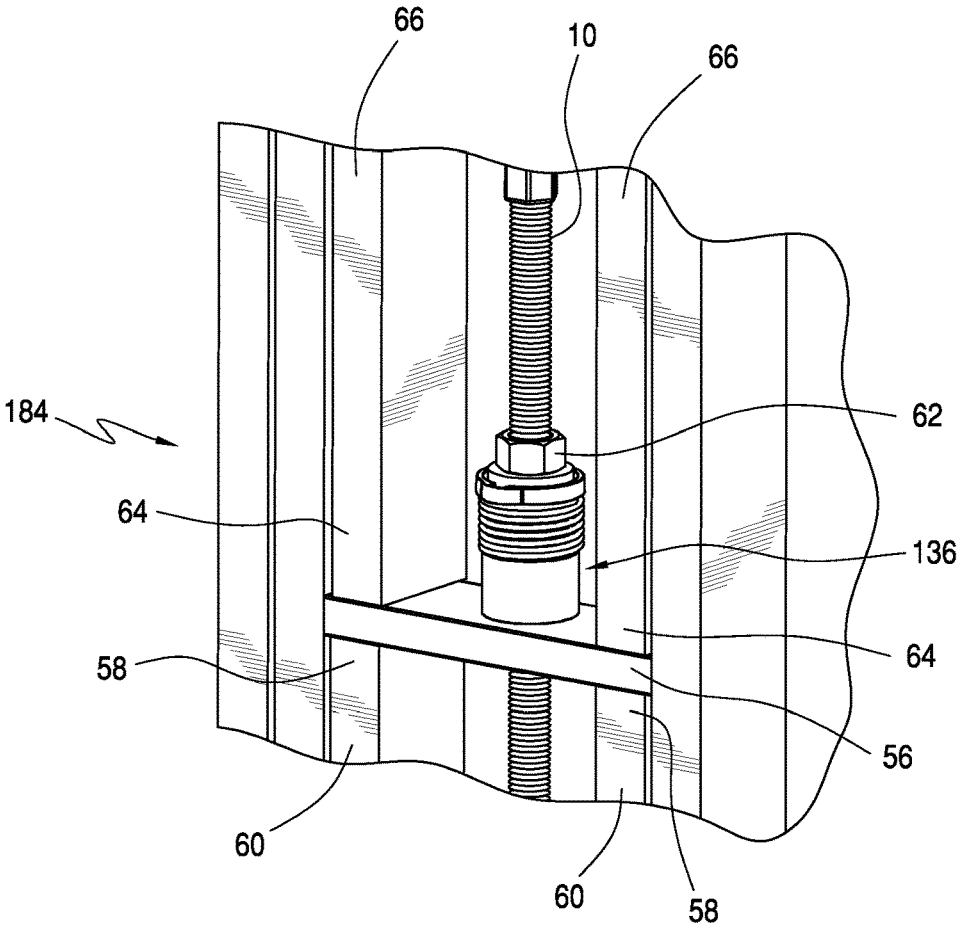

FIG. 32 is a perspective, fragmentary view of another embodiment of FIG. 6 of the details of attachment of the wall system at midfloor.

FIG. 32A is a side elevational view of FIG. 32 with some components of the wall system removed for clarity.

DETAILED DESCRIPTION OF THE INVENTION

Referring to FIGS. 1 and 2, a hold down system 2 made in accordance with the present invention is disclosed for a two-story wall system. The system 2 includes a foundation anchor 4 operably attached to a foundation 6 of a building. The foundation anchor 4 includes a threaded rod 8 attached to another threaded or tie-rod rod 10 by means of a coupling 12. A bearing member 14 bears upon a bottom plate 16, which is a component of the stud wall system 18. A nut 20 secures the bearing member 14 to the bottom plate 16.

The system 2 is disposed within the wall system 18 between two studs 24 reinforced by two additional studs 26. The studs 24 are attached to the reinforcement studs 26 by nails, screws or other conventional means. The bottom ends 28 of the reinforcement studs 26 bear on top of the bearing member 14, transferring the load to the bottom plate 16 and to the foundation 6 below. The reinforcement studs 26 extends to and terminates at the bottom of the top plate 29. For ease of description, the components that attach the wall system 18 to the foundation 6 is designated as foundation attachment 30.

The bearing member 14 advantageously provides a bearing surface against the bottom plate of the wall system for distribution of forces that may tend to lift the wall off the foundation.

Referring to FIGS. 1 and 3, the tie rod 10 continues through the second floor of the two-story wall system 18. Another bearing member 32 bears on a bottom plate 34. A nut 36 secures the bearing member 32 to the bottom plate 34. Reinforcement studs 38 have bottom ends 40 bearing on the bearing member 32, transferring the load to the bottom plate 34 and to the reinforcement studs 26 below.

Referring to FIG. 3A, the tie rod 10 extends through the bearing member 32 between two web flanges 68 (see FIG. 7). Compressive forces exerted by the nut 36 are transferred through the web flanges directly below the nut to the bottom plate 34. Compressive forces from the reinforcement studs 38 whose bottom ends 40 bear on top of the bearing member 14 are transmitted through the web flanges 68 and the side walls 70 (see FIG. 7).

For ease of reference, the components that attach the tie rod 10 to the bottom plate 34 are designated as floor attachment 37.

Referring to FIGS. 1 and 4, the top ends 42 of the reinforcement studs 38 support a bridge member 44. A nut 46 secures the bridge member 44 to the reinforcement studs 38. The bridge member 44 bears down on the reinforcement studs 38, transferring the load to the bottom plate 34 and to the reinforcement studs 26 below. The reinforcement studs 38 terminate short of the top plate 47. As in the first floor, the system 2 is disposed between two studs 49 that extend from the bottom plate 34 to the top plate 47.

Referring to FIG. 4A, the tie rod 10 extends through the bridge member 44 through an off-centered slot 84 (see FIG. 9). The tie rod 10 passes through the slot 84 between the internal web flanges 78. Compressive forces of the nut 46 are transmitted to the reinforcement studs 42 through the web flanges, which are substantially directly below the nut 46.

For ease of references, the components that attach the termination of the tie rod 10 to the wall system 18 are designated as termination attachment 48.

It should be understood that building foundation is used to refer generally to any structure that is used to anchor or tie a building to the ground. Examples are foundation walls, horizontal beams connected to vertical beams driven or buried in the ground, or any substantial structure solidly anchored in the ground. Accordingly, a building foundation can be any structure that is capable of transferring the load of the building to the ground.

FIG. 5 discloses a three-story wall system 50 using a hold down system 52 similar to the system 2 with some modifications. The system 52 includes the foundation anchor 4 operably attached to a foundation 6 of a building. The foundation anchor 4 includes the threaded rod 8 attached to another threaded or tie-rod rod 10 by means of the coupling 12.

Referring to FIGS. 3 and 5, the system 52 also includes floor attachments 37 and a termination attachment 48, as in the system 2. In addition, the system 52 includes midfloor attachments 54 between the first and second floors, and midfloor attachment 55 between the second and third floors. The floor attachment 37 shown in FIG. 3 is the same as that shown in FIG. 5.

Referring to FIGS. 5 and 6, the midfloor attachment 54 includes a bearing member 56 on the top ends 58 of reinforcement studs 60. A nut 62 secures the bearing member 56 to the reinforcement studs 60. The bottom ends 64 of reinforcement studs 66 bear on the top surface of the bearing member 56. The reinforcement studs 66 bear down on the bridge member 56, transferring the load to the reinforcement studs 60 below. The bottom ends of the reinforcement studs 60 bear down on the bottom plate 16, transferring the load to the foundation 6 below. The reinforcement studs 60 and 66 extend from the bottom plate 16 to the bearing member 56, and from the bearing member 56 to the top plate 29, respectively. Studs 71 extend between the bottom plate 34 and the top plate 47 and are attached to the reinforcement studs 69 and 67 by nails, screws or other standard means.

The midfloor attachment 55 is similar to the midfloor attachment 54, except that reinforcement studs 67 have their bottom ends bearing on the bearing member 32.

The various hold down systems disclosed above are shown installed within the first stud bay from the end of a shear wall using standard wood framing construction. However, the hold down systems are not limited to these locations or type of construction. They may be installed in any stud wall construction to resist uplift during high wind or earthquake conditions. The hold down system may be installed in the first stud bay at the first bay after a window or door opening. Generally, the hold down system may be installed anywhere inside a stud wall as the application dictates.

The bearing members 14, 32, and 56 are identical to each other, except for their location in the wall system. In the following description, reference will only be made to bearing member 14 with the understanding that it also applies to the other bearing members 32 and 56.

Referring to FIG. 7, the bearing member 14 is hollow and longitudinal, made of metal, such as aluminum, steel or non-metallic other materials and may be extruded or molded, having internal web flanges 68 and outside side walls 70 connecting a top wall 72 and a bottom wall 74. The web flanges 68 extend along the longitudinal axis of the bearing member 14. Each of the web flanges 68 has a middle portion 65, a top edge portion 67 attached to the top wall 72 and bottom edge portion 69 attached to the bottom wall 74. The top edge portion 67 and the bottom edge portion 69 have increasing thickness in a direction from the middle portion 65 to the top wall 72 or the bottom wall 74. The top wall 72 and the bottom wall 74 are preferably parallel to each other and extend along the longitudinal axis of the bearing member. The side walls 70 are preferably parallel to each other and extend along the longitudinal axis of the bearing member. 14. An opening 76 through the top wall 72 and the bottom wall 74 allows the tie rod 10 to extend therethrough. The opening 76 is preferably machined, rather than being punched, to avoid compromising the strength of the area immediately around the opening. The bearing member 14 is preferably extruded aluminum, to reduce manufacturing and shipping costs. The lightweight aluminum also provides less strain to the worker during handling and installation. As shown in FIG. 8, the opposite edges of the opening 76 as viewed in cross-section are advantageously disposed adjacent the respective the web flanges 68 for efficient transfer of vertical forces.

Referring to FIG. 9, the bridge member 44 is longitudinal and made of metal, such as aluminum, steel, or other non-metallic materials and may be extruded or molded. The bridge member has internal web flanges 78 connected to a top wall 80 and a bottom wall 82. The web flanges 78 extend along the longitudinal axis of the member 44. Each of the web flanges 78 has a middle portion 77, a top edge portion 79 attached to the top wall 80 and bottom edge portion 81 attached to the bottom wall 82. The top edge portion 79 and the bottom edge portion 81 have increasing thickness in a direction from the middle portion 77 to the top wall 80 or the bottom wall 82. The top wall 80 and the bottom wall 82 are preferably parallel to each other and extend along the longitudinal axis of the bridge member 44. An elongated opening or slot 84 through the top wall 80 and the bottom wall 82 allows the tie rod 10 to extend therethrough. The slot 84 extends along the longitudinal axis of the bridge member 44. The slot 84 is advantageously off-center to accommodate an installation where the tie rod 10 is not exactly on-center between the studs. One end 85 of the slot is centered along the length and longitudinal axis of the bridge member, while the opposite end 87 is off-center. The off-centered slot 84 will accommodate an off-centered tie rod in either direction of the slot by merely turning the bridge member 44 180° as needed. The slot 80 is preferably machined rather than being punched to avoid comprising the strength of the area around the slot. The bridge member 44 is preferably extruded aluminum, due to its lightweight for reduced manufacturing and shipping costs and the lightweight aluminum provides less strain in handling and installation for the worker. As shown in FIG. 10, the opposite edges of the slot 84, as seen in cross-section, are advantageously disposed adjacent the respective web flanges 48 for efficient transfer of vertical forces.

The bridge member 44 simplifies the installation of a hold down system, requiring less number of components as compared to using a wood bridge typically made of several wood members. The metal bridge member 44 advantageously provides for higher loads as compared to wood bridge members, since "parallel to grain of lumber" loading is used (typically 1200 psi), as compared to "perpendicular to grain of lumber" loading when using wood bridge members (typically 625 psi).

Referring to FIGS. 1 and 5, the use of bearing members 14, 32 and 56 where the reinforcement studs 66 and 69 bear down from above advantageously eliminates the "perpendicular to grain" loading of prior art wood bridge member, thereby increasing the loading capacity of the hold down system. The bridge member 44 and the bearing members 14, 32 and 56 may be color coded for material type, capacity and dimensional size.

As load passes through the support studs and or wall studs through the parallel wood grain, this surface is in bearing contact with each end of the bearing members 14, 32 and 56. The use of the bearing members as a bottom-plate-compression plates lowers the compression force per square inch upon the perpendicular wood bearing surface below. As load is transferred from the support studs and or wall studs through the bearing member, the load is dispersed and spread out because the bearing member is minimally designed not to bend or deflect. The physical properties of the bearing member provide this behavior when used in this fashion. So a concentrated force from the contact point of the studs at each end of the top of the bearing member is then spread out over the large area of contact to the perpendicular wood bearing surface underneath the bearing plate.

Placement of the bearing member and bridge member is intended for the relative center of the first stud bay of a wall in a building which uses wall studs of many different types of framing material. They may also be installed at each end of a wall. They may also centrally be located in any stud bay of a wall or every stud bay of a wall. The transfer of parallel to grain force or load from support studs and or wall studs bearing upon the upper top side of the metallic bridge block is transferred to the lower support studs and or wall studs through the metallic bridge member. The physical properties of the bridge member 44 do not allow any crushing or displacement between studs parallel to grain bearing surfaces; therefore force or load is transferred with a stable load path.

Bridge member and/or bearing member can be employed to resist uplift and rotation of a wall of a building and also are utilized when the wall in a compression mode. Because of behaviors described earlier above, the bridge member and/or bearing member disperses loads and achieves lowering concentrated forces between bearing surfaces when down-load forces occurs. This advantageously helps solve load path problems in current hold down systems.

Another embodiment of the foundation attachment 86 is disclosed in FIG. 11. The foundation attachment 86 is similar to the foundation attachment 30, except for the addition of a second bearing member 88 bearing on top of the bearing member 14.

Referring to FIGS. 12 and 13, the bearing member 88 is hollow, made of metal, such as aluminum, steel or other non-metallic materials. The bearing member 88 has an axis along its length. The bearing member 88 has internal web flanges 90, oriented along the axial length of the member, and preferably parallel outside side walls 92 connected to a top wall 94 and a bottom wall 96. The top wall 94 and the bottom wall 96 are preferably parallel to each other. The top, bottom and side walls are oriented along the axial length of the member. An opening 98 through the top wall 94 and the bottom wall 96 allows the tie rod 10 to extend therethrough. The opening 98 is preferably machined, rather than being punched, to avoid comprising the strength of the area immediately around the opening 98. The opposite edges of the opening 98, as seen in cross-section in FIG. 13, are advantageously disposed adjacent the respective web flanges 90 for efficient transfer of vertical forces. The bearing member 88 is preferably extruded aluminum to reduce manufacturing and shipping costs. The lightweight aluminum also provides less strain to the worker during handling and installation. The bearing member 88 is the same as the bearing member 116, except for their location in the wall system.

The bearing member 88 serves to spread the load from the nut 20 over a wider area and provides a greater resistance to the nut 20 from digging into the openings 98 and 76 as the wall system tries to lift up or shift due to wind or earthquake forces. As shown in FIG. 13A, the holes 76 and 98 line up vertically, along with the web flanges 68 and 90.

Bridge member 44 and bearing members 14 and 88 are not limited to metallic materials. The physical properties of the bridge member and the bearing must be equal to or greater than the physical properties of the support studs bearing surface.

Another embodiment of a foundation attachment 100 is disclosed in FIG. 14. The foundation attachment 100 is similar to the foundation attachment 86, except that the bearing member 88 is replaced with a solid metal bearing member 102.

Another embodiment of a foundation attachment 104 is disclosed in FIG. 15. The foundation attachment 104 is similar to the foundation attachment 30, except that swivel washers 106 and 108 have been added between the nut 20 and the bearing member 14. The swivel washer 106 has a convex top surface 110 that mates with a corresponding concave bottom surface 112 on the swivel washer 108. The washers 106 and 108 allow the threaded rod 10 to be out of the vertical while maintaining maximum bearing contact with the bearing member 14. The washers 106 and 108 allow for centering the rod 10 while providing full bearing contact between bearing surfaces. The washers 106 and 108 may also be used in the other embodiments of the floor, midfloor and termination attachments shown throughout this disclosure where the tie rod 10 may be off-vertical.

Another embodiment of a floor attachment 114 is disclosed in FIG. 17. The floor attachment 114 is similar to the floor attachment 37, except that a second bearing member 116 is provided on top of the bearing member 32. The bearing member 116 is the same as the bearing member 88 shown in FIG. 12. The bearing member 116 provides additional loading capacity to the bearing member 32 by spreading the compressive force of the nut 36 over a wider area.

Referring to FIG. 17A, the bearing member 116 lines up over the bearing member 32 such that their respective internal web flanges 90 and 68 substantially vertically line up. Compressive force from the nut 36 is thus transferred through the web flanges 68 and 90, which are substantially directly below the nut 36. Bending of the bearing member 32 due to uplift of the wall is thus reduced, increasing the loading capacity of the bearing member 32.

Figure 18:
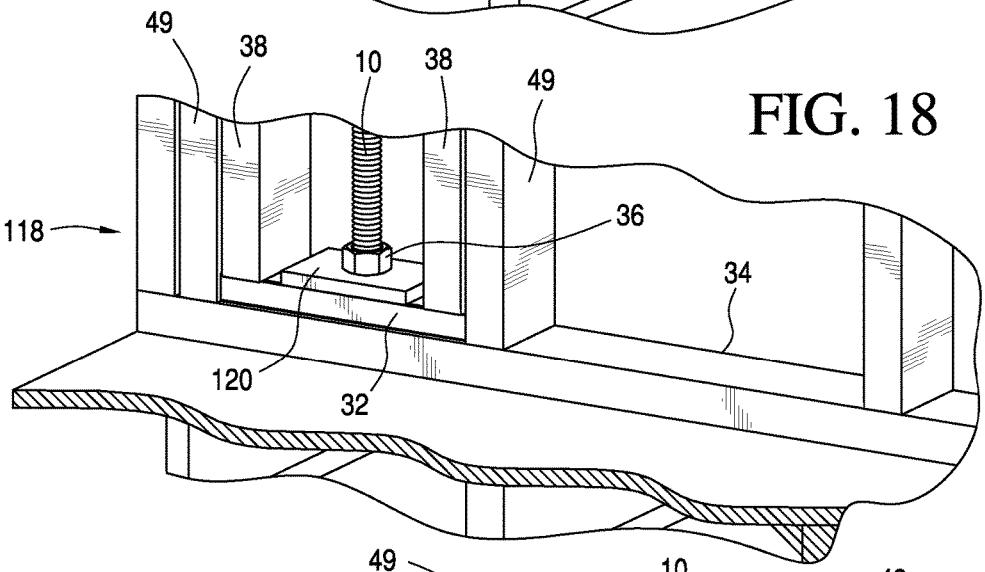

Another embodiment of a floor attachment 118 is shown in FIG. 18. The floor attachment 118 is similar to the floor attachment 114 except that a solid metal bearing member 120 is used in lieu of the hollow bearing member 116.

Another embodiment of a floor attachment 122 is shown in FIG. 19. The floor attachment 122 includes the bearing member 116, which is identical to the bearing member 88. Swivel washers 106 and 108 are interposed between a nut 36 and the bearing member 116. The bearing member 116 bears on the bottom plate 34. Reinforcement studs 123 extend from the bottom plate 34 to the top plate 47. The bottom ends 125 of the reinforcement studs 123 extend past the outer edges of the bearing member 116 and bear directly on the bottom plate 34.

Another embodiment of a floor attachment 121 is shown in FIG. 19A. The floor attachment 121 is similar to the floor attachment 122, except that the washers 106 and 108 have been replaced with the tensioning device 136 (see FIG. 21). The web flanges 90 are disposed directly underneath the outer cylindrical member 146 for transmission of the load to the bottom plate 34. The side walls 92 provide additional rigidity to the hollow structure of the bearing member 116. The tie rod 10 passes between the web flanges 90 for effective distribution of load.

Another embodiment of a floor attachment 134 is disclosed in FIG. 20. The floor attachment 134 is similar to the floor attachment 118, shown in FIG. 18, except that a tensioning device 136 is interposed between the nut 36 and the solid metal bearing member 120. The tensioning device 136 automatically expands to take up slack that may develop in the tie rod 10. The nut 36 secures the device 136 against the bearing members 120 and 32.

Examples of the device 136 are disclosed in U.S. Pat. No. 6,161,350, Publ. No. 2006/0156657, and applicant's pending application Ser. No. 11/898,479, all of which are hereby incorporated by reference.

Referring to FIG. 21, a specific example the device 136 disclosed in application Ser. No. 11/898,479, Pub. No. 2008-0060297 will be described. The device 136 comprises an inner cylindrical inner member 144 through which the tie rod 10 passes. The inner member 144 is disposed within an outer cylindrical member 146. A spring 148 operably axially urges the members 144 and 146 apart such that pressure is maintained against the bearing member 120 and tension on the tie rod 10. Keeping the position of the nut 36 on the tie rod 10 as a fixed reference point, the outer member 146 is movable relative to the inner member 144 toward the foundation to keep the floor plate 34 under compression and the tie rod 10 under tension. The outer member 146 is locked relative to the inner member 144 in a direction away from the foundation when the wall is lifted up from the foundation. The outer member 146 and the inner member 144 include opposing cylindrical walls with respective plurality of 149 and 151 receiving volume. Resilient members 153 disposed between the opposing cylindrical walls are biased to occupy the receiving volumes 151. The receiving volumes 149 and 151 are configured in cross-section such that when the outer member 146 is moved toward the foundation to take up slack in the tie rod 10, the resilient members 153 are shifted into and fully received within the respective receiving volumes 149. The receiving volumes 149 and 151 are further configured in cross-section such that when the outer member 146 is pushed in the direction away from the foundation, the resilient members are only partially received within the respective receiving volumes 151 to preclude movement of the outer member 146, thereby locking the member 146 to the inner member 144. The device 136 is available from Earthbound Corporation, Monroe, Wash.

The present invention is not limited to the device 136 as described above, since other tensioning devices are available that provides the same function of re-tensioning the tie rod 10 when the wall shrinks to effectively keep the wall under compression.

Another embodiment of a floor attachment 150 is disclosed in FIG. 22. The floor attachment 150 is similar to the floor attachment 114 shown in FIG. 17, except that the device 136 is interposed between the nut 36 and bearing member 116.

The floor attachment 150 is shown in side view in FIG. 22A, with some of the wall components removed for clarity. The internal web flanges 68 and 90 substantially line up vertically and are disposed directly below the outer member 146 of the device 136 for effective transmission of load to the bottom plate 34. Additionally, the side walls 70 and 92 substantially line up vertically to provide additional load transfer paths to the bottom plate 34. The bearing member 116 advantageously spreads the load over the underlying bearing member 32 to minimize bending of the bearing member 32 when uplift forces tries to lift the wall up.

Another embodiment of a floor attachment 155 is disclosed in FIG. 22B. The floor attachment 155 is similar to the floor attachment 150, except that the bearing member 116 has been removed. This embodiment is used when the expected load is lower.

Another embodiment of a termination attachment 152 is disclosed in FIG. 23. The termination attachment 152 is similar to the termination attachment 48 shown in FIG. 4, except that a second bearing member 154 is disposed between the nut 46 and bridge member 44. The bearing member 154 is identical to the bearing member 88 shown in FIG. 12.

The termination attachment 152 is shown in side view in FIG. 23A. The web flanges 90 of the bearing member 154 are disposed substantially directly underneath the nut 46 to effectively transfer the compression load to the web flanges 78 of the bridge member 44 below. The bearing member 154 spreads the compression load over a larger area to minimize bending of the bridge member 44 during wall uplift.

Another embodiment of a termination attachment 156 is disclosed in FIG. 24. The termination attachment 156 is similar to the termination attachment 152, except that the bearing member 154 is replaced with a solid metal bearing member 158.

Another embodiment of a termination attachment 160 is disclosed in FIG. 25. The termination attachment 160 is similar to the termination attachment 48 shown in FIG. 4, except that swivel washers 106 and 108 are interposed between the nut 46 and the bridge member 44.

Another embodiment of a termination attachment 162 is disclosed in FIG. 26. The termination attachment 162 is similar to the termination attachment 48 shown in FIG. 4, except that a tensioning device 136, shown in FIG. 21, is interposed between the nut 46 and the bridge member 44.

The termination attachment 162 is shown in side elevational view in FIG. 26A. The tie rod 10 passes between the web flanges 78 which are substantially directly underneath the device 136 for effective transmission of load to the reinforcement studs 38.

Another embodiment of a termination attachment 164 is disclosed in FIG. 27. The termination attachment 164 is similar to the termination attachment 162 shown in FIG. 26, except that a bearing member 154 is disposed between the device 136 and the bridge member 44.

The termination attachment 164 is shown in side view in FIG. 27A. The web flanges 90 of the bearing member 154 are disposed directly underneath the device 136 to effectively transfer the compression load to the web flanges 78 of the bridge member 44 below. Additionally, the side walls 92 provide additional load transfer paths to the bridge member 44. The bearing member 154 advantageously spreads the load over the underlying bridge member 44 to minimize bending of the bridge member 44 when uplift forces tries to lift the wall up.

The bearing member 154 spreads the compression load over a larger area to minimize bending of the bridge member 44 during wall uplift.

Figure 28:
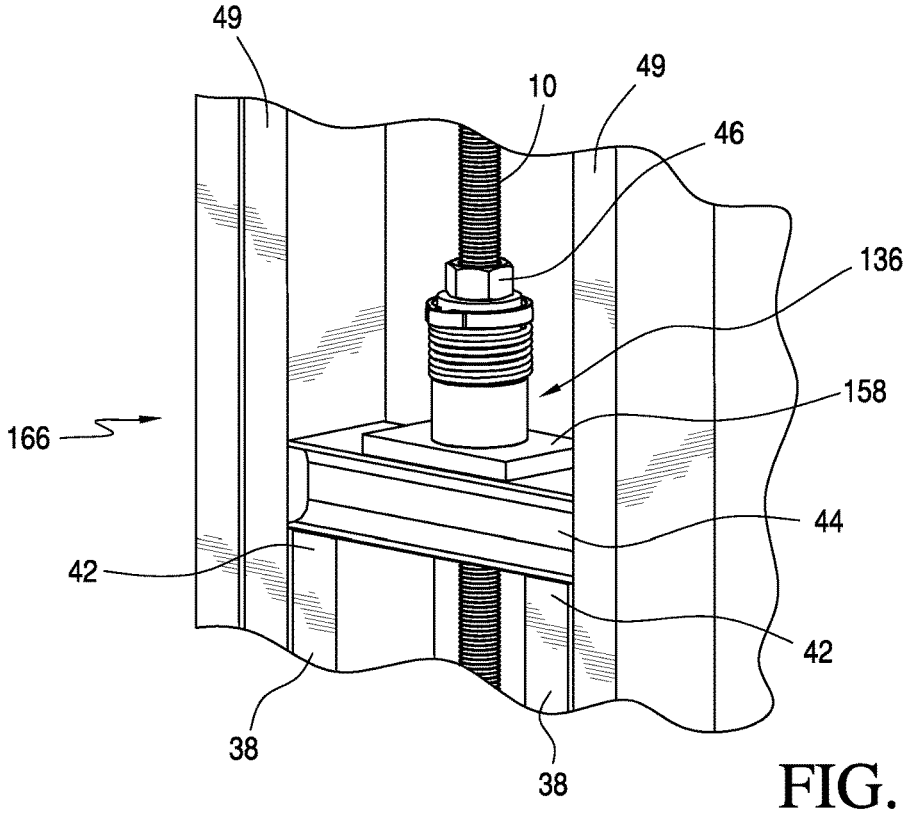

Another embodiment of a termination attachment 166 is disclosed in FIG. 28. The termination attachment 166 is similar to the termination attachment 164 shown in FIG. 27, except that the bearing member 154 is replaced with a solid metal bearing member 158.

Figure 29:
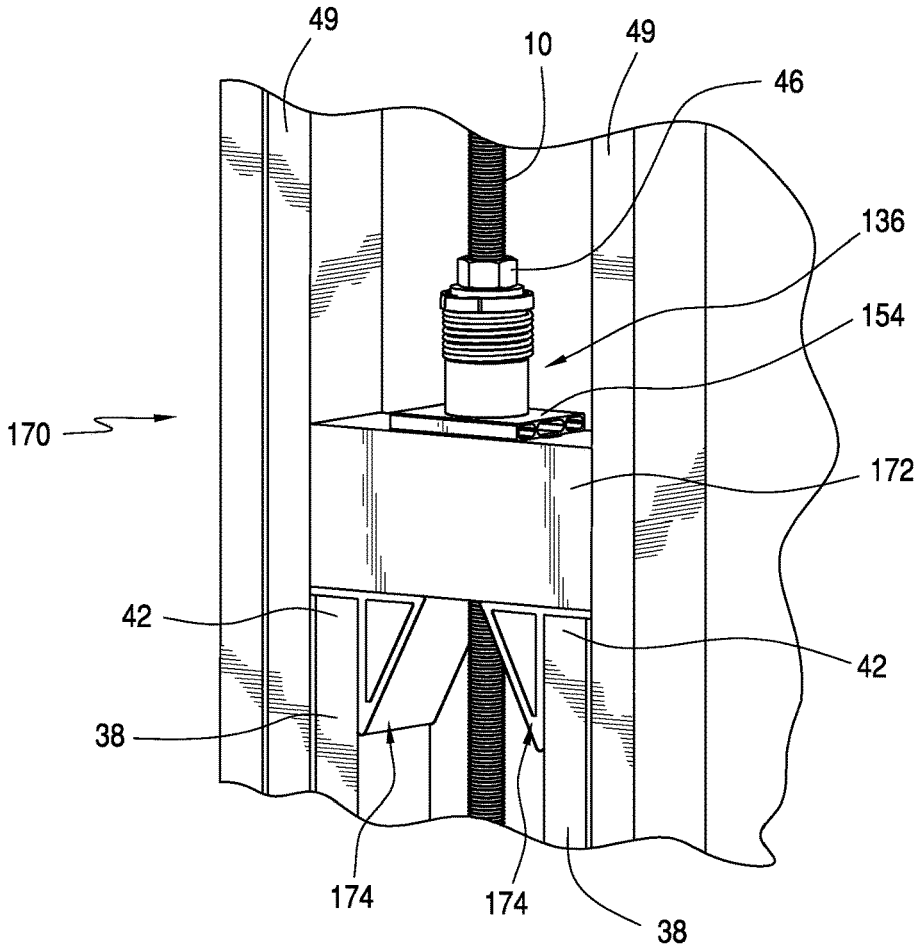

Another embodiment of a termination attachment 170 is disclosed in FIG. 29. The termination attachment 170 is similar to the termination attachment 164 shown in FIG. 27, except that the bridge member 44 is replaced with a solid bridge member 172 made of wood, plastic or composite material. The bridge member 172 includes an opening through it to permit the tie rod 10 to pass through. Hollow brackets 174 are provided underneath the bridge member 172 to effectively shorten the span distance of the bridge member between the reinforcement studs 38.

The bracket 174 includes a horizontal member 176, a vertical member 178 and an angle member 180. The vertical member 178 is preferably perpendicular to the horizontal member 176 to form an inverted L-shape so that the horizontal portion may be disposed on the top end with the vertical member 178 engaging the vertical surface of the reinforcement stud 38. The angle member 180 forms an inverted triangle with a portion of the horizontal member 176 and the vertical member 178. A hole 182 is used for nailing or screwing the horizontal member 176 to the end portion 42 of the reinforcement stud. The bracket 174 is made of metal, such as aluminum and steel, or other non-metallic materials, and may be extruded or molded. The bracket 174 is preferably extruded aluminum to save manufacturing and shipping costs and to lessen the strain on the worker during handling and installation.

Referring to FIG. 29, the vertical forces not directly over the end portions 42 of the reinforcement studs 38 are transmitted by the horizontal members 176 through the angle members 180 and onto the vertical reinforcement studs 38. This effectively shortens the span of the bridge member 172 to allow for greater load capacity. The brackets 174 provide an arch structure across the span between the reinforcement studs 38, thereby effectively transmitting the load to the reinforcement studs 38. The brackets 174 advantageously allow greater load to be carried by the bridge member 172 than without their use. The use of the bearing member 154 advantageously allows the load to be spread over a larger area of the bridge member 172, thereby reducing the force directly bearing over the span not directly over the horizontal members 176 of the brackets 174.

Another embodiment of a midfloor attachment 184 is disclosed in FIG. 32. The midfloor attachment 184 is similar to the midfloor attachment 55, except that a tensioning device 136 is interposed between the nut 62 and the bearing member 56.

The midfloor attachment 184 is shown in side elevational view in FIG. 32A. Compressive forces exerted by the device 136 are transferred through the web flanges 68 directly below the device 136 to the reinforcement studs 58. The side walls 70 provide further load paths to the reinforcements studs 58.

It should be understood that the use of the swivel washers 106 and 108 may be used with any of the other components, such as the bearing member 14, the bridge member 44 or the device 136. Similarly, the use of the bearing member 88 may be used in the various embodiments of the hold down system as needed, depending on for the expected load.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention.

I claim:

1. A structural member for a reinforced stud wall including a tie rod, said structural member comprising:

a) a horizontal longitudinal hollow bearing member having a horizontal longitudinal axis and having horizontal and parallel top and bottom walls extending along said horizontal longitudinal axis, said top and bottom walls are configured to support a downward compression force transverse to said top wall from the tie rod when the tie rod is attached to said top wall;

b) first and second web flanges connecting said top and bottom walls, said first and second web flanges each including a middle portion, a top edge portion attached to said top wall and a bottom edge portion attached to said bottom wall, said top edge portion and said bottom edge portion increasing in thickness in a direction from said middle portion to said top wall or said bottom wall, said first and second web flanges extending along said longitudinal axis of said hollow bearing member, said first and second web flanges are configured to transfer the downward compression force on said top wall to said bottom wall;

c) an opening through said top and bottom walls for allowing the tie rod to extend vertically therethrough, said opening being confined within a space between vertical portions of said first and second web flanges; and d) said structural member having a depth configured to be disposed within a depth of the stud wall when said top and bottom walls and said first and second web flanges are disposed horizontally within and parallel to the stud wall.

2. A structural member as in claim 1, wherein said opening includes opposite edge portions disposed adjacent respective said first and second web flanges.

3. A structural member as in claim 1, wherein said opening is circular.

4. A structural member as in claim 1, wherein said opening is elongated.

5. A structural member as in claim 4, wherein one end of said opening is centered along the length of said hollow bearing member and another end opposite to said one end is off-center.

6. A structural member as in claim 1, wherein said opening is machined.

7. A structural member as in claim 1, wherein said hollow bearing member is extruded aluminum.

8. A structural member as in claim 1, and further comprising outside side walls connecting said top and bottom walls and extending along said longitudinal axis.

* * * * *